US011079169B2

(12) United States Patent
Lee et al.

(10) Patent No.: US 11,079,169 B2
(45) Date of Patent: Aug. 3, 2021

(54) REFRIGERATOR

(71) Applicant: SAMSUNG ELECTRONICS CO., LTD., Suwon-si (KR)

(72) Inventors: Jeong Hyun Lee, Suwon-si (KR); Yang-Yeol Gu, Gwangju (KR); Hyung Bum Lee, Hwaseong-si (KR); Nam Gu Choi, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 148 days.

(21) Appl. No.: 15/698,297

(22) Filed: Sep. 7, 2017

(65) Prior Publication Data

US 2018/0087827 A1 Mar. 29, 2018

(30) Foreign Application Priority Data

Sep. 26, 2016 (KR) ..... 10-2016-0123364

(51) Int. Cl.
*F25D 23/12* (2006.01)
*F25D 23/02* (2006.01)

(52) U.S. Cl.
CPC ..... *F25D 23/126* (2013.01); *F25D 23/02* (2013.01); *F25D 23/028* (2013.01); *F25D 2323/122* (2013.01); *F25D 2331/806* (2013.01)

(58) Field of Classification Search
CPC ..... F25D 23/00; F25D 23/02; F25D 23/028; F25D 23/12; F25D 23/126; F25D 2323/00; F25D 2323/122; F25D 2331/00; F25D 2331/806
USPC ..... 62/389
See application file for complete search history.

(56) References Cited

U.S. PATENT DOCUMENTS 3,982,406 A * 9/1976 Hanson ..... F25D 23/126 62/339
5,474,213 A * 12/1995 Unger ..... F25C 5/22 222/108
7,673,472 B2 * 3/2010 Kwon ..... F25D 23/02 62/398
7,762,292 B2 * 7/2010 Buchstab ..... A47J 31/4482 141/369

(Continued)

FOREIGN PATENT DOCUMENTS

CN 202470593 10/2012
CN 204648805 9/2015

(Continued)

OTHER PUBLICATIONS

European Patent Office issued Communication under Rule 71(3) EPC in European Application No. 17192757.7 dated Oct. 18, 2018 (48 pages).

(Continued)

*Primary Examiner* — Len Tran
*Assistant Examiner* — Gustavo A Hincapie Serna
(74) *Attorney, Agent, or Firm* — Staas & Halsey LLP

(57) ABSTRACT

A refrigerator includes a main body having a storage compartment, a door to open or close the storage compartment, and a dispenser provided on the door and configured to supply water to the outside of the main body, wherein the door includes, a door plate, and a door cap coupled to a lower end portion of the door plate and having a water collecting part to collect residual water of the dispenser.

10 Claims, 23 Drawing Sheets

(56) References Cited

U.S. PATENT DOCUMENTS

| | | | | |
|---|---|---|---|---|
| 8,141,748 | B2 * | 3/2012 | Kim | F25C 5/22 222/182 |
| 8,333,305 | B2 * | 12/2012 | Kim | F25C 5/22 222/504 |
| 8,695,853 | B2 * | 4/2014 | Savan | F25D 23/126 222/173 |
| 8,881,951 | B2 * | 11/2014 | Hwang | F25D 23/04 222/146.1 |
| 8,966,927 | B2 * | 3/2015 | Eckartsberg | F16B 5/0208 62/389 |
| 9,285,159 | B2 * | 3/2016 | Kim | F25D 23/126 |
| 9,506,682 | B2 * | 11/2016 | Yun | F25D 23/126 |
| 9,738,504 | B2 * | 8/2017 | Aranda | B67D 1/0014 |
| 2004/0182103 | A1 | 9/2004 | Jung | |
| 2005/0268638 | A1 * | 12/2005 | Voglewede | F25D 23/126 62/389 |
| 2008/0174220 | A1 | 7/2008 | Kim et al. | |
| 2010/0043480 | A1 * | 2/2010 | Koo | F25D 23/126 62/389 |
| 2010/0071401 | A1 * | 3/2010 | Jang | F25D 23/028 62/391 |
| 2010/0259147 | A1 * | 10/2010 | Koo | F25D 23/02 312/405 |
| 2011/0041542 | A1 | 2/2011 | Brunner et al. | |
| 2015/0276293 | A1 * | 10/2015 | Seo | F25C 5/22 222/1 |
| 2016/0265836 | A1 * | 9/2016 | Hong | F25D 23/028 |

FOREIGN PATENT DOCUMENTS

| | | |
|---|---|---|
| DE | 10 2006 062 359 A1 | 6/2008 |
| EP | 0 779 485 A2 | 6/1997 |
| KR | 10-1999-0017795 | 3/1999 |
| KR | 10-0797480 | 1/2008 |
| KR | 10-2008-0076654 | 8/2008 |
| KR | 10-2013-0010978 | 1/2013 |

OTHER PUBLICATIONS

Extended European Search Report dated Jan. 16, 2018, in corresponding European Patent Application No. 17192757.7, 5 pgs.

European Office Action dated Apr. 30, 2018 in corresponding European Patent Application No. 17 192 757.7, 4 pgs.

Chinese Office Action dated Aug. 28, 2020 in Chinese Patent Application No. 201710878870.2.

Chinese Office Action dated Apr. 1, 2021 in Chinese Patent Application No. 201710878870.2.

* cited by examiner

REFRIGERATOR

CROSS-REFERENCE TO RELATED APPLICATION(S)

This application claims the benefit of Korean Patent Application No. 10-2016-0123364, filed on Sep. 26, 2016, in the Korean Intellectual Property Office, the disclosure of which is incorporated herein by reference.

BACKGROUND

1. Field

Embodiments of the present disclosure relate to a refrigerator, and more particularly, to a refrigerator having a dispenser.

2. Description of the Related Art

Generally, a refrigerator includes a storage compartment and a cool air supplying device to supply cool air to the storage compartment to keep food fresh.

The storage compartment may be provided with a front surface openable to put food in or take food out, and the openable front surface may be opened or closed by a door. In response to user needs, refrigerators are provided with a dispenser for enabling a user to receive water and/or ice without having to open the door.

The dispenser is generally provided approximately at the central portion of the door. Specifically, the dispenser may be installed in the door by forming a hole for mounting the dispenser in a substantially central portion of the door, and then mounting a dispenser case having the dispenser in the hole.

However, such a conventional dispenser needs to have a water collecting part capable of collecting residual water in the dispenser case or separately from the dispenser case, which increases the number of parts and increases the material cost.

SUMMARY

One aspect of the present disclosure discloses a refrigerator that may reduce the number of parts and reduce the material cost.

Another aspect of the present disclosure discloses a refrigerator that improves the design of a door having a dispenser.

Still another aspect of the present disclosure discloses a refrigerator that improves a method of assembling an ice kit.

In accordance with one aspect of the present disclosure, a refrigerator includes a main body having a storage compartment, a door to open or close the storage compartment, and a dispenser provided on the door and configured to supply water to an outside of the main body, wherein the door includes, a door plate and a door cap coupled to a lower end portion of the door plate and having a water collecting part to collect residual water of the dispenser.

The door plate may include a front cover portion to cover a front surface of the dispenser.

The front cover portion may be depressed on an outer surface of the door plate.

The dispenser may have a discharge part, and the front cover portion may include a discharge part opening provided to expose at least a portion of the discharge part to an outside of the door.

The discharge part may include a lever to operate the dispenser to discharge water, and at least a portion of the lever may be exposed to the outside of the door through the discharge part opening.

The water collecting part may be depressed on an upper surface of the door cap.

The refrigerator may further include a dispenser cover coupled to the door plate and to cover a rear of the dispenser.

The door plate may include a support member provided at the lower end portion of the door plate, and the door cap may be coupled to the support member.

The refrigerator may further include a dispenser cover configured to cover a rear of the dispenser and may be configured to be coupled to the support member in a snap-fit manner.

The door cap may be configured to be coupled to the support member in a snap-fit manner.

The support member may include at least one first coupling portion coupled to the dispenser cover, and at least one second coupling portion coupled to the door cap.

The water collecting part may be attachable to or detachable from the door cap.

The door cap may be provided to correspond to a shape of the water collecting part and may further include a seating portion on which the water collecting part is seated.

The dispenser may be provided at a lower end portion of the door.

The dispenser may include a reinforcing plate in contact with a portion of a rear surface of the door plate and may provide to support the portion of the rear surface of the door plate.

In accordance with another aspect of the present disclosure, a refrigerator includes a main body having a storage compartment, a door having a door plate that forms an outer appearance thereof and configured to open or close the storage compartment, and a dispenser provided at a lower end portion of the door and configured to supply water to an outside of the main body, wherein the door plate includes a front cover portion that is depressed on an outer surface of the door plate to cover a front surface of the dispenser.

The door may further include a door cap to cover a lower end portion of the door plate and provided with a water collecting part to collect residual water of the dispenser.

The dispenser may have a discharge part, and the front cover portion may include a discharge part opening provided to expose at least a portion of the discharge part to an outside of the door.

In accordance with still another aspect of the present disclosure, a refrigerator includes a main body having a storage compartment, a door to open or close the storage compartment, and a dispenser provided at a lower end portion of the door and configured to supply water to an outside of the main body, wherein the door includes, a door plate, a support member provided at a lower end portion of the door plate, a door cap coupled to the support member, and a water collecting part attachable to or detachable from the door cap and provided to collect residual water of the dispenser, wherein the door cap has a seating portion on which the water collecting part is seated.

The door plate may include a front cover portion which is depressed on an outer surface of the door plate.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
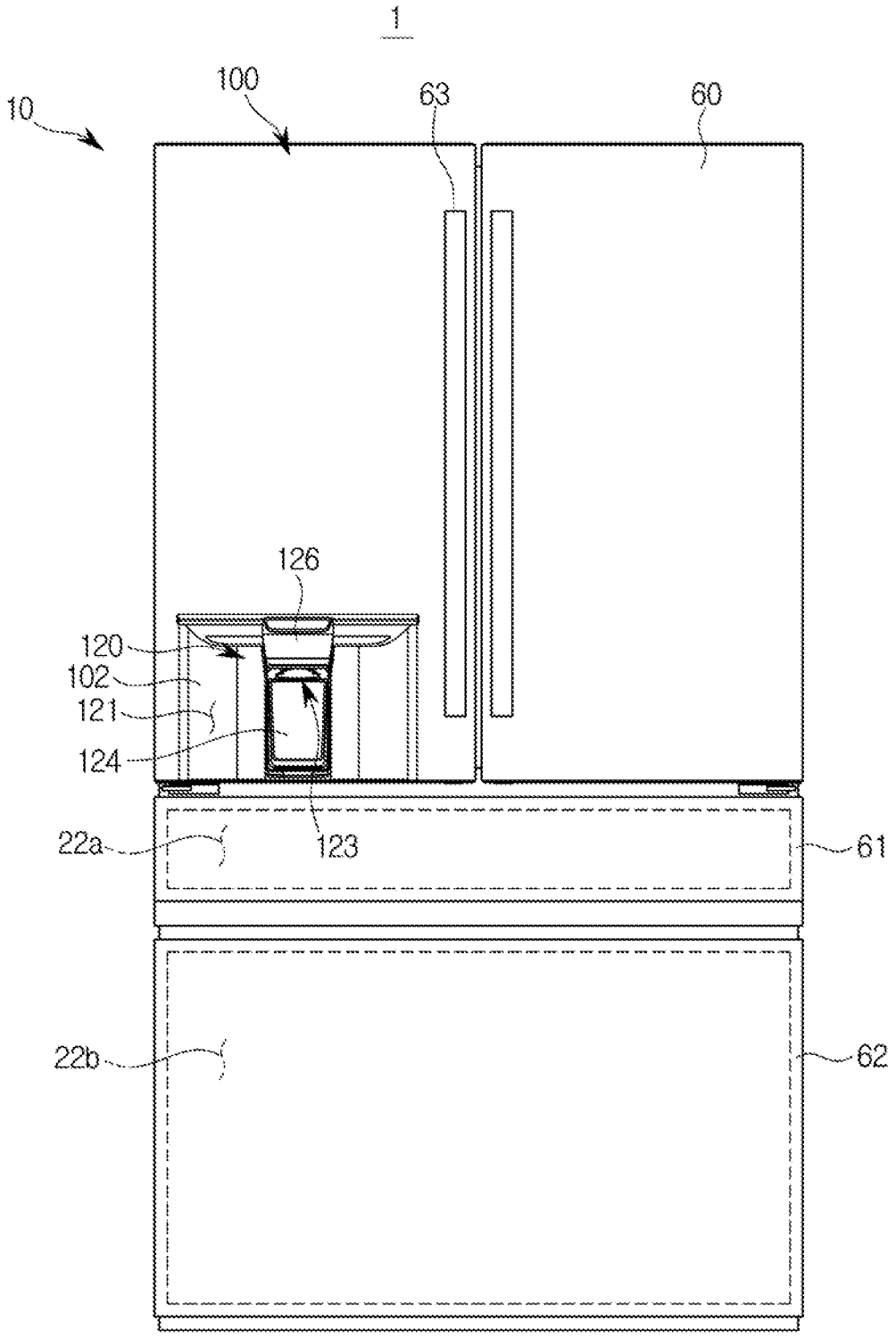
FIG. 1 is a view illustrating a front surface of a refrigerator according to an embodiment of the present disclosure.

Configurations illustrated in embodiments and the drawings described in the present specification are only exemplary embodiments of the present disclosure, and thus it is to be understood that various modified examples, which may replace the embodiments and the drawings described in the present specification, are possible when filing the present application.

Like reference numerals or symbols provided in the drawings of the present specification represent members or components that perform substantially the same functions.

The terms used in the present specification are used to describe exemplary embodiments of the present disclosure. Accordingly, it should be apparent to those skilled in the art that the following description of exemplary embodiments of the present disclosure is provided for illustrative purposes only and not for the purpose of limiting the present disclosure as defined by the appended claims and their equivalents. It is to be understood that the singular forms "a," "an," and "the" include plural referents unless the context clearly dictates otherwise. It will be understood that when the terms "includes," "comprises," "including," and/or "comprising" when used in this specification, specify the presence of stated features, figures, operations, components, or combinations thereof, but do not preclude the presence or addition of one or more other features, figures, steps, components, members, or combinations thereof.

It will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of the associated listed items.

The terms "front-end," "rear-end," "upper portion," "lower portion," "upper end," "lower end," and the like used in the following descriptions are defined based on the drawings, and the shape and position of each component are not limited by the terms.

Hereinafter, the embodiments of the present disclosure will be described in detail with reference to the accompanying drawings in detail.

Figure 2:
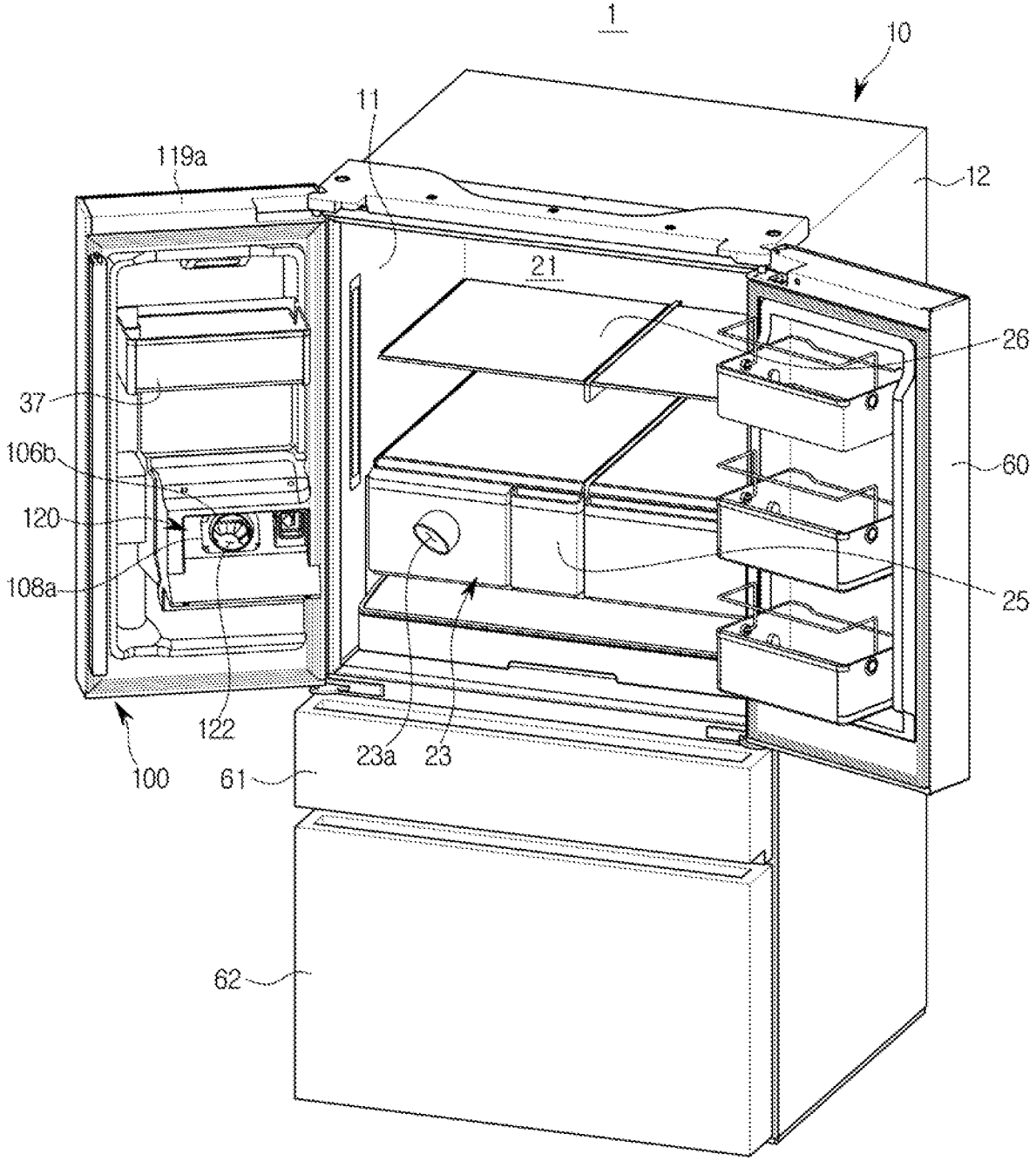
FIG. 2 is a view illustrating a door of the refrigerator opened according to an embodiment of the present disclosure.

FIG. 1 is a view illustrating a front surface of a refrigerator 1 according to an embodiment of the present disclosure. FIG. 2 is a view illustrating doors 100, 60 of the refrigerator 1 opened according to an embodiment of the present disclosure.

Referring to FIGS. 1 and 2, the refrigerator 1 according to an embodiment of the present disclosure may include a main body 10, storage compartments 21, 22*a*, 22*b* formed inside the main body 10 to store food, a cool air supplying device (not shown) to supply cool air to the storage compartments 21, 22*a*, 22*b*, and doors 100, 60, 61, 62 to open or close the storage compartments 21, 22*a*, 22*b*.

The main body 10 may have a substantially box shape and may be provided so that the front surface of the main body 10 is opened. The main body 10 may include an inner case 11 and an outer case 12 that is coupled to the outside of the inner case 11, and insulation material (not shown) provided between the inner case 11 and the outer case 12.

The inner case 11 may be formed by injection molding with a resin material. The storage compartments 21, 22*a*, 22*b* may be formed in the inner case 11. The outer case 12 may be formed of a metal material. The insulation material may include urethane foam insulation or a vacuum insulation panel.

The urethane foam insulation material may be formed by filling and foaming a foamed urethane in which urethane and a foaming agent are mixed between the inner case 11 and the outer case 12 after the inner case 11 and the outer case 12 are combined. Since the foamed urethane has a strong adhesive force, the bonding strength between the inner case 11 and the outer case 12 may be strengthened, and when the foaming is completed, sufficient strength may be obtained.

The storage compartments 21, 22*a*, 22*b* may include the refrigerating compartment 21 formed in the upper portion of the main body 10, and freezing compartments 22*a*, 22*b* formed in the lower portion of the main body 10. The refrigerating compartment 21 may be maintained at about 0° C. to 5° C., so that the food may be refrigerated and stored. The freezing compartments 22*a*, 22*b* may be maintained at about 0° C. to −30° C., so that the food may be frozen and stored. The storage compartments 21, 22*a*, 22*b* are provided with a shelf 26 on which food may be placed, and a container 25 capable of containing food.

The refrigerator 1 may include an ice making chamber 23 configured to make, store and crush ice. The ice making chamber 23 may be disposed in the refrigerating compartment 21. The ice making chamber 23 may be provided in the main body 10 to be separated from the refrigerating compartment 21.

The cool air supplying device may generate cool air using the latent heat of evaporation of the refrigerant and supply the cool air to the storage compartments 21, 22*a*, 22*b*. The cool air supplying device may include a compressor, a condenser, an expansion device, an evaporator, and a blower fan.

A machine room (not shown) in which a compressor for compressing the refrigerant and a condenser for condensing the compressed refrigerant are installed at the rear lower side of the main body 10.

The refrigerating compartment 21 may be opened and closed by the pair of doors 100, 60. The pair of doors 100, 60 may be rotatably provided to the main body 10 through a hinge member. The freezing compartments 22*a*, 22*b* may be opened or closed by drawer-type doors 61, 62 slidably provided in the main body 10. The doors 100, 60 opening or closing the refrigerating compartment 21 may be provided with a door guard 37 to store food.

A handle 63 may be provided on the pair of doors 100, 60 to open or close the refrigerating compartment 21. A user may easily open or close the doors 100, 60 by grasping the handle 63. The handle 63 may be provided to extend along the vertical direction of the doors 100, 60.

The left door 100 among the doors 100, 60 opening or closing the refrigerating compartment 21 may be provided with a dispenser 120 to provided water or ice. However, the present disclosure is not limited to this, and the dispenser 120 may be provided on the right door 60. The user may be supplied with water and/or ice without opening the upper door 100 through the dispenser 120. In the present embodiment, the left door 100 will be described in detail with respect to a case where the dispenser 120 is provided on the left door 100 for convenience of explanation. Hereinafter, the left door 100 is referred to as the door 100.

Figure 3:
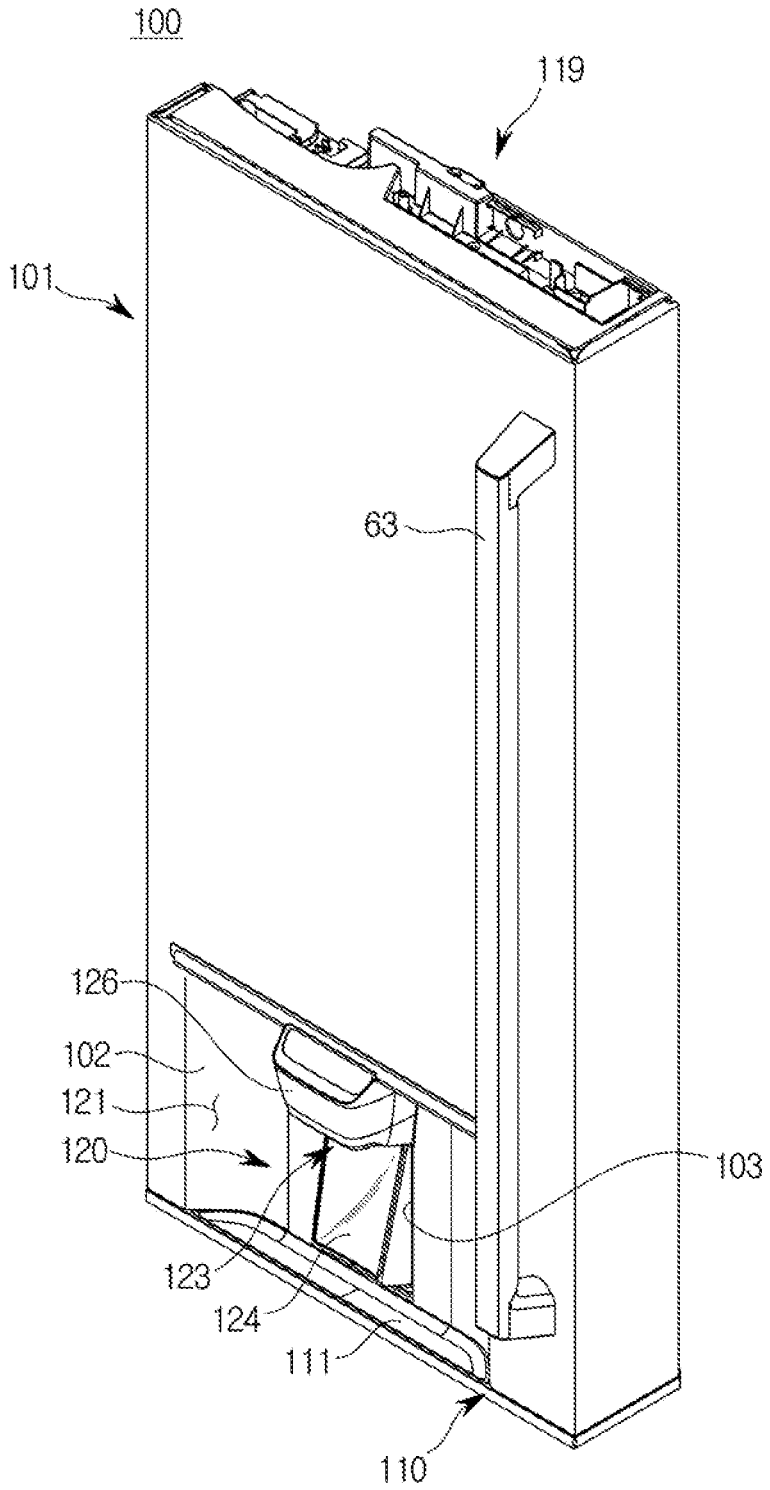
FIG. 3 is a view illustrating the door of the refrigerator shown in FIG. 1.
Figure 4:
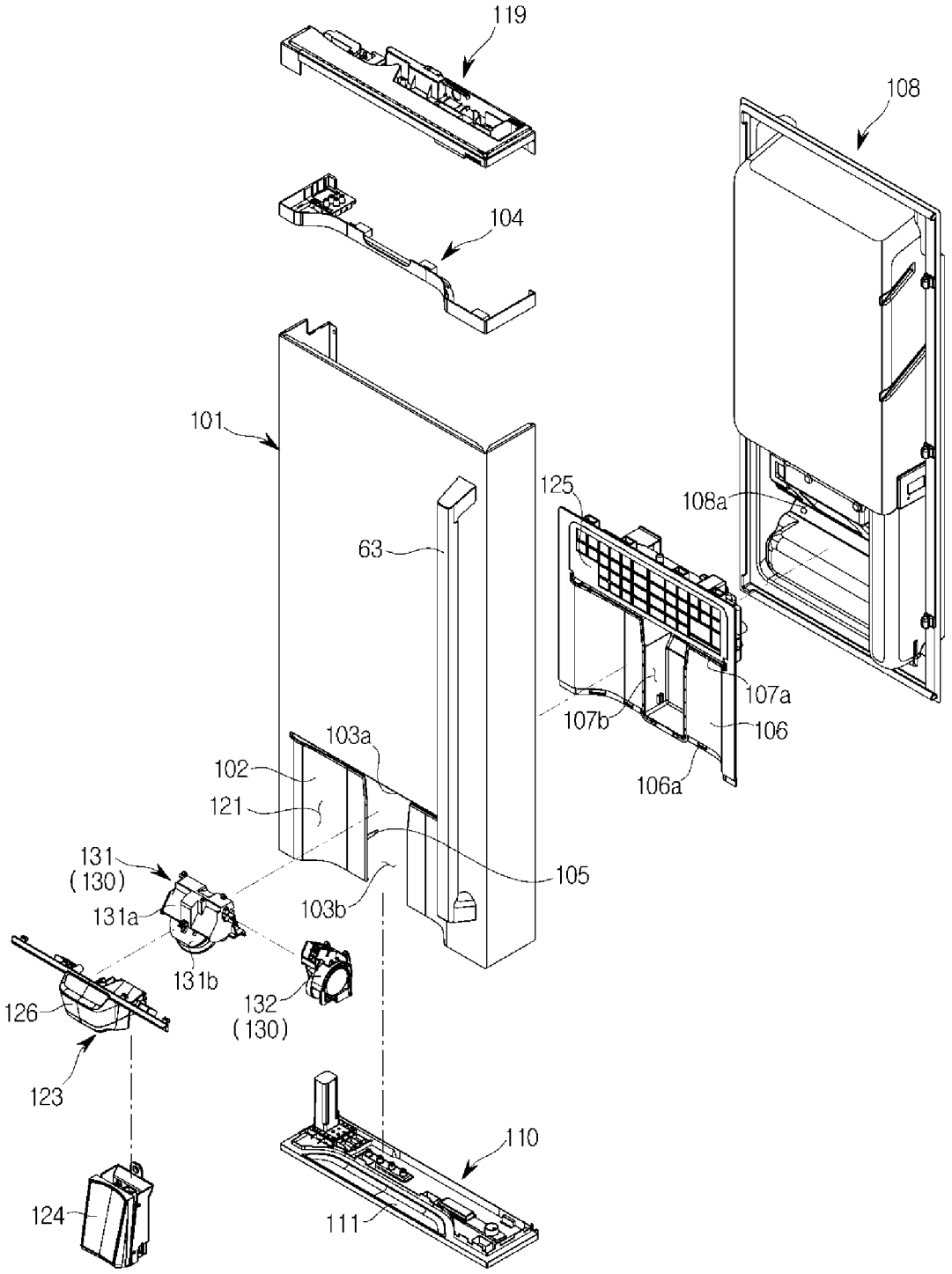
FIGS. 4 and 5 are exploded views of the door shown in FIG. 3.
Figure 5:
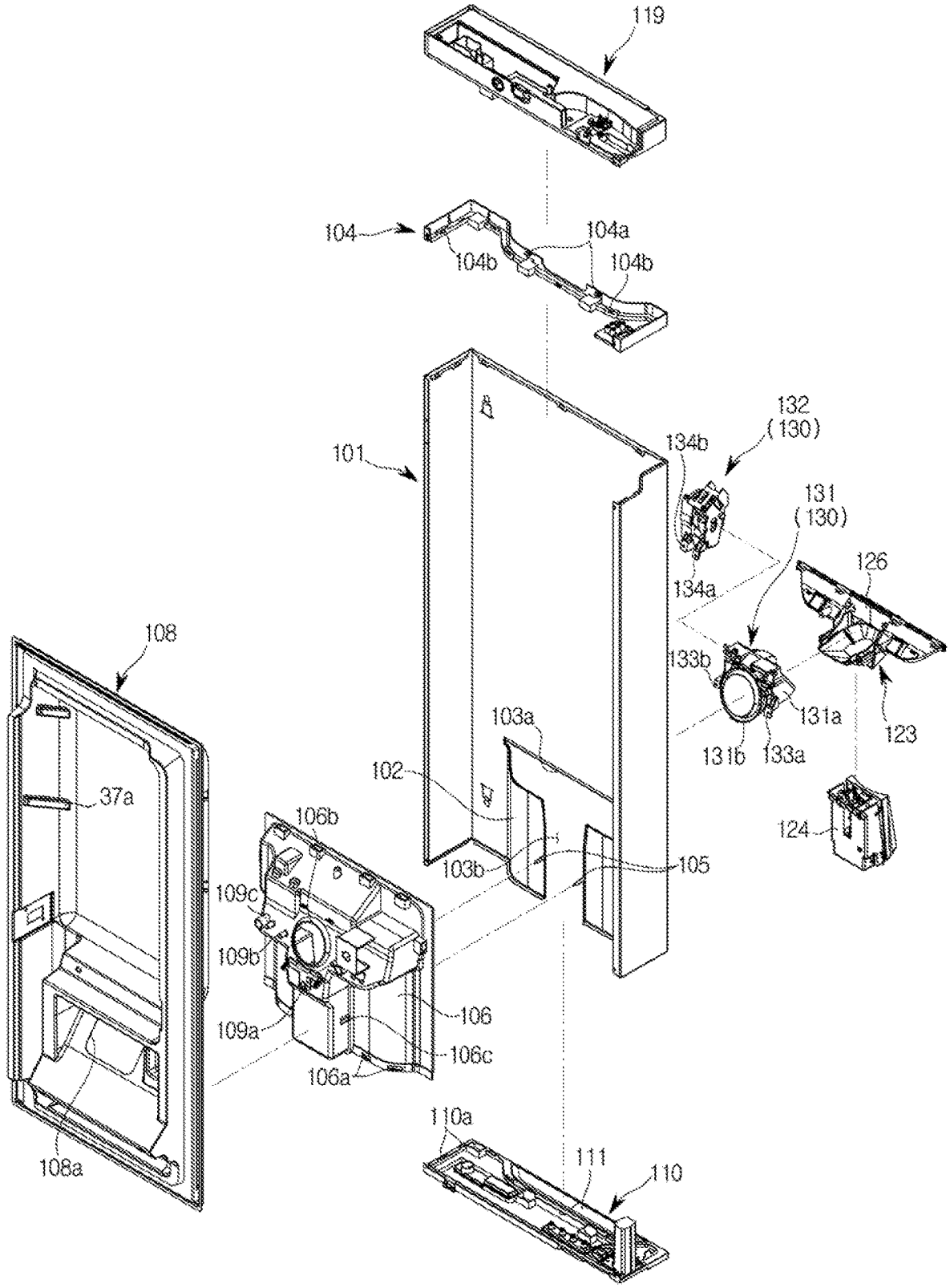
Figure 6:
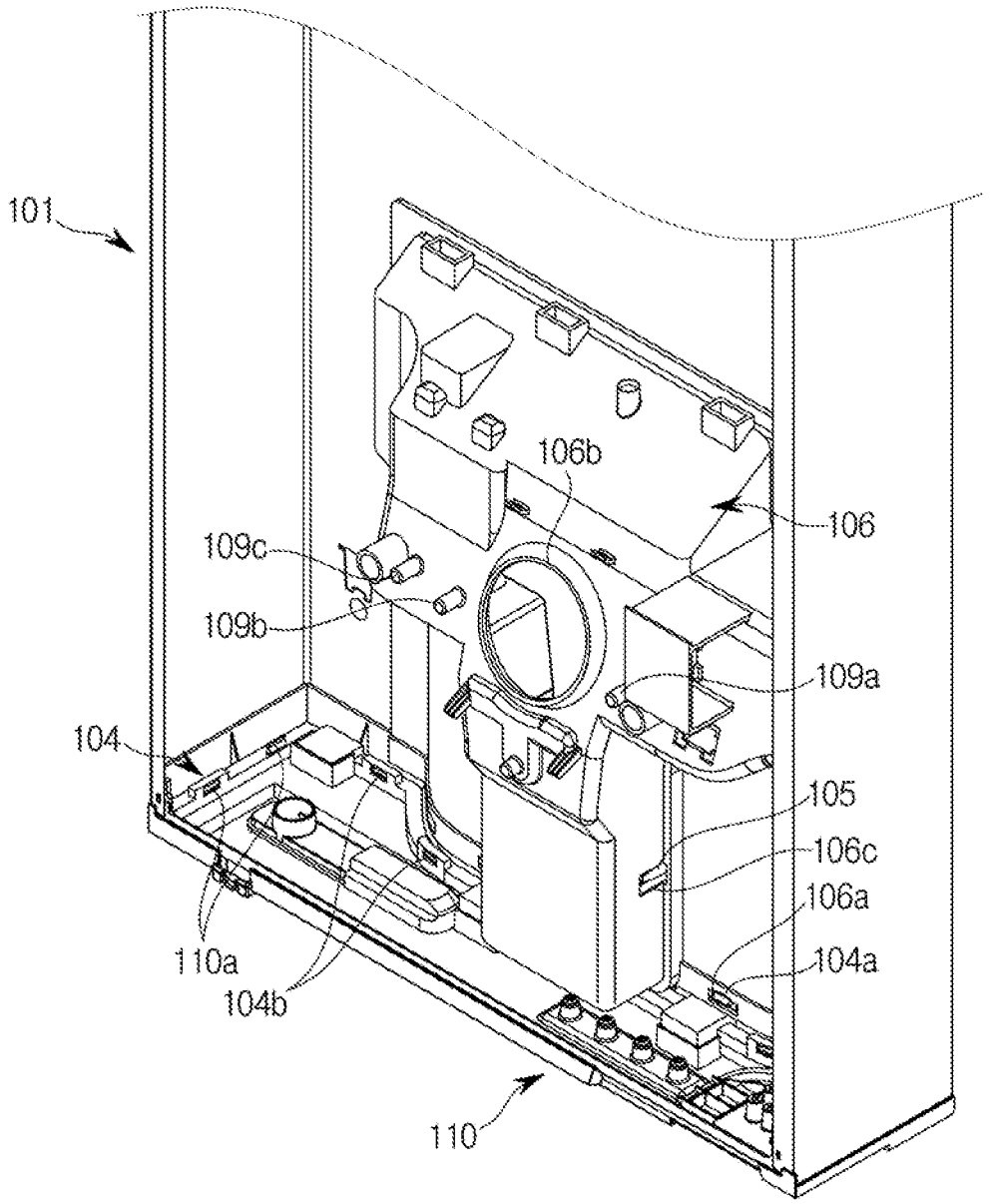
FIG. 6 is a view illustrating a coupling structure of a support member, a dispenser cover and a lower door cap in the door shown in FIG. 3.
Figure 7:
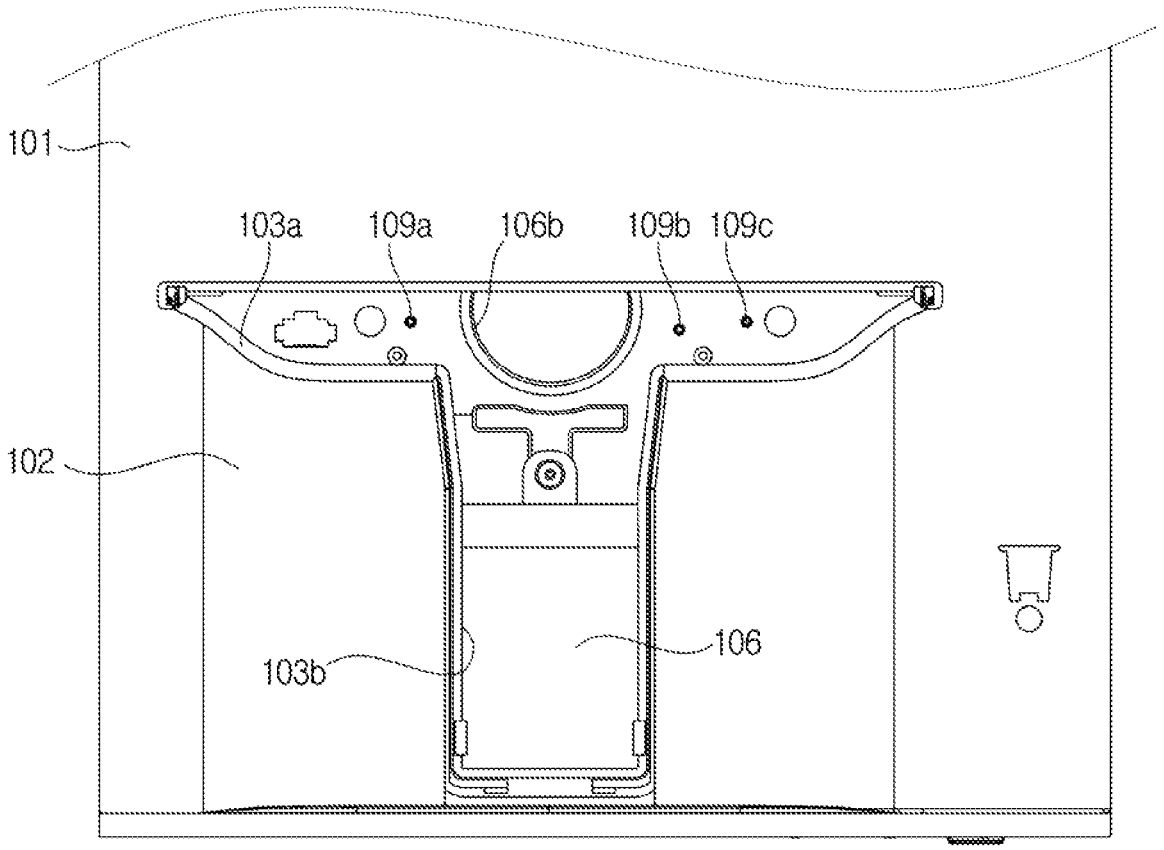
FIG. 7 is a view illustrating a state before an ice kit, a discharge part, a discharge part cover and a lever of the door shown in FIG. 4 are mounted on the door.

FIG. 3 is a view illustrating the door 100 of the refrigerator 1 shown in FIG. 1. FIGS. 4 and 5 are exploded views of the door 100 shown in FIG. 3. FIG. 6 is a view illustrating a coupling structure of a support member 104, a dispenser cover 106 and a lower door cap 110 in the door shown in FIG. 3. FIG. 7 is a view illustrating a state before an ice kit 130, a discharge part 123, a discharge part cover 126 and a lever 124 of the door 100 shown in FIG. 4 are mounted on the door.

The door 100 may include a door plate 101 provided to open or close the refrigerating compartment 21, a rear cover 108 coupled to the rear of the door plate 101, the lower door cap 110 coupled to a lower end portion of the door plate 101, and an upper door cap 119 coupled to an upper end portion of the door plate 101.

The door plate 101 may form an outer appearance of the door and may include a metal material such as the outer case 12. The handle 63 may be installed on the door plate 101. The door plate 101 may include a front cover portion 102 covering a front surface of the dispenser 120.

The front cover portion 102 may be depressed on the outer surface of the door plate 101. The front cover portion 102 may be recessed on the door plate 101. According to this configuration, a dispensing space 121 to be described later may be provided at a portion where the front cover portion 102 of the door plate 101 is provided.

The front cover portion 102 may include discharge part openings 103*a*, 103*b* which are provided to externally expose at least a portion of the discharge part 123 and at least a portion of the lever 124. The discharge part openings 103*a*, 103*b* may include the first discharge part opening 103*a* for exposing the discharge part cover 126 covering the discharge part 123 of the dispenser 120 to the outside, and the second discharge part opening 103*b* for exposing at least a portion of the lever 124 to the outside. Specifically, the discharge part openings 103*a*, 103*b* may be formed in a portion of the front cover portion 102 corresponding to the position where the discharge part cover 126 and the lever 124 of the dispenser 120 are mounted when the dispenser 120 is mounted on the rear surface of the door plate 101. According to this configuration, at least a portion of the discharge part cover 126 covering the discharge part 123 and at least a portion of the lever 124 may be exposed to the outside of the door 100.

The front cover portion 102 may include a coupling protrusion 105 protruding rearward from the rear surface thereof. The coupling protrusion 105 may be inserted into a coupling groove 106*c* of the dispenser cover 106 to be described later. Accordingly, the dispenser cover 106 may be fixed to the door plate 101. The coupling protrusion 105 may be formed by bending a side surface of the front cover portion 102 on which the discharge part openings 103*a*, 103*b* are formed. Referring to FIG. 5, two coupling protrusions 105 are shown, but the present disclosure is not limited thereto, and three or more coupling protrusions 105 may be provided.

The door plate 101 may include the support member 104 coupled to a lower end portion thereof. The support member 104 may be injection molded. The support member 104 may include a high impact poly styrene (HIPS) material. The refrigerator 1 according to the embodiment of the present disclosure may reduce the material cost by applying the support member 104 made of a relatively inexpensive HIPS material. However, the support member 104 may not include the HIPS material and may include other materials as necessary.

The support member 104 may be mounted on the lower end portion of the door plate 101. Specifically, the support member 104 may be seated in a bending portion 101*a* of the door plate 101. (See FIG. 8)

Referring to FIG. 6, the support member 104 may include at least one first coupling portion 104*a* to which the dispenser cover 106 is coupled. The first coupling portion 104*a* may be provided in a hook shape. The first coupling portion 104*a* may be coupled to a third coupling portion 106*a* of the dispenser cover 106, which is provided in a hole shape, in a snap-fit manner. However, the coupling between the support member 104 and the dispenser cover 106 is merely an example, and conversely, a hole-shaped coupling portion may be formed on the support member 104 and a hook-shaped coupling portion may be formed on the dispenser cover 106 so that the hole-shaped coupling portion and the hook-shaped coupling portion may be coupled, and it is also possible for both of them to be screwed together by screws.

The support member 104 may include at least one second coupling portion 104*b* to which the lower door cap 110 is coupled. The second coupling portion 104*b* may be provided in a hole shape. The second coupling portion 104*b* may be coupled to a fourth coupling portion 110*a* of the lower door cap 110, which is provided in a hook shape, in a snap-fit manner. However, the coupling between the support member 104 and the lower door cap 110 is merely an example, and conversely, a hook-shaped coupling portion may be formed on the support member 104 and a hole-shaped coupling portion may be formed on the lower door cap 110 so that the hole-shaped coupling portion and the hook-shaped coupling portion may be coupled, and it is also possible for both of them to be screwed together by screws.

The rear cover 108 may include a sealing member (not shown) that is in close contact with the main body 10 when the door 100 is closed to seal the storage compartment 21. The sealing member may include a rubber material.

Insulation material (not shown) may be provided between the door plate 101 and the rear cover 108. Accordingly, the door 100 may prevent the cool air in the refrigerating compartment 21 from flowing out.

The rear cover 108 may include a cover opening 108*a* forming a chute 122 connecting the ice making chamber 23 and the dispenser 120. The cover opening 108*a* may be connected to an ice making chamber opening 23*a* of the ice making chamber 23 and may form the chute 122 to guide the ice of the ice making chamber 23 to the dispensing space 121.

The rear cover 108 may be provided with a guard mounting portion 37*a* provided on the rear surface thereof so that the door guard may be mounted.

The lower door cap 110 may be coupled to the lower end portion of the door plate 101. Specifically, the lower door cap 110 may be coupled to the support member 104 of the door plate 101. Accordingly, the lower door cap 110 may cover the lower end portion of the door plate 101.

The lower door cap 110 may include an acrylonitrile-butadiene-styrene resin (ABS resin). Since the lower door cap 110 includes the ABS resin, the required rigidity may be ensured. However, the lower door cap 110 is not limited to the ABS resin, and any material may be used as long as it has a minimum required stiffness. The lower door cap 110 may be injection molded.

The lower door cap 110 may include a water collecting part 111 to collect water and/or ice discharged from the dispenser 120. The water collecting part 111 may be depressed on the upper surface of the lower door cap 110. In FIG. 3, the water collecting part 111 is formed on all portions of the upper surface of the lower door cap 110, alternatively, it may be formed on a portion of the upper surface of the lower door cap 110 corresponding to the discharge part 123. According to this configuration, the water and/or ice collected in the water collecting part 111 may be taken out and removed from the water collecting part 111 directly by the user.

The upper door cap 119 may be coupled to the upper end portion of the door plate 101. Accordingly, the upper door cap 119 may cover the upper end portion of the door plate 101. In addition, the upper door cap 119 may include an additional cover 119*a* (See FIG. 22) that covers a portion other than the portion to which the hinge is coupled to make the outer appearance of the door 100 clean.

The door 100 may include the dispenser 120 that provides water and/or ice to the exterior of the main body 10. The dispenser 120 may be provided at the lower end portion of the door 100 so that a lower end of the door 100 and a lower end of the dispenser 120 may substantially coincide. The dispenser 120 may include the dispensing space 121 on which a container such as a cup is placed and supplied with water and/or ice, the chute 122 to guide the ice of the ice making chamber 23 to the dispensing space 121, the discharge part 123 through which water and/or ice is discharged, the lever 124 configured to actuate the dispenser 120, and the discharge part cover 126 covering at least a portion of the discharge part 123.

The dispensing space 121 may be provided at a portion where the front cover portion 102 of the door plate 101 is formed. Specifically, the dispensing space 121 may be defined as a space in which the front cover portion 102 is depressed and the water collecting part 111 of the lower door cap 110 may be disposed on a lower surface of the dispensing space 121. Accordingly, when the user removes the container from the dispensing space 121 after receiving water and/or ice through the dispensing space 121 using the container, the water collecting part 111 may collect the remaining water and/or ice flowing from the discharge part 123. In addition, when receiving water and/or ice using the container in the dispensing space 121, the water collecting part 111 may collect overflowing water and/or ice in the container.

The dispensing space 121 may be provided in consideration of the size of the container and the front cover portion 102 may be further depressed to the inside of the door plate 101 than shown in FIG. 3 as necessary.

The chute 122 may be provided to guide the ice in the ice making chamber 23 to the dispensing space 121. The chute 122 may be formed from the cover opening 108*a* of the rear cover 108 to the discharge part 123 through a discharge port 106*b* of the dispenser cover 106.

The discharge part 123 may be configured to provide water and/or ice to the exterior of the door 100. The discharge part 123 may be connected to the ice making chamber 23 through the chute 122. At least a portion of the discharge part 123 may be covered by the discharge part cover 126. The discharge part 123 may be exposed to the outside of the door 100 through the first discharge part opening 103*a* in a state in which at least one portion is covered by the discharge part cover 126.

The lever 124 may be provided on the lower side of the discharge part 123. When the lever 124 is pressed, the dispenser 120 discharges water and/or ice through the discharge part 123. The lever 124 may be exposed to the outside of the door 100 through the second discharge part opening 103*b*.

The dispenser 120 may include the dispenser cover 106. The dispenser cover 106 may be coupled to the rear of the door plate 101 to cover the rear of the dispenser 120. Specifically, the dispenser cover 106 may be coupled to the support member 104 to cover the rear of the dispenser 120.

The dispenser cover 106 may include an acrylonitrile-butadiene-styrene resin (ABS resin). Since the dispenser cover 106 includes ABS resin, the required rigidity may be ensured. However, the dispenser cover 106 is not limited to the ABS resin, and any material may be used as long as it has a minimum required stiffness. The dispenser cover 106 may be injection molded.

The dispenser cover 106 may include the discharge port 106*b* connected to the discharge part 123 to discharge the ice guided through the chute 122 to the outside.

The dispenser cover 106 may include the coupling groove 106*c* into which the coupling protrusion 105 formed in the door plate 101 is inserted. The coupling groove 106*c* may include a portion provided in a shape corresponding to the shape of the coupling protrusion 105 so that the dispenser cover 106 may be fixed to the door plate 101 as the coupling protrusion 105 is inserted into the coupling groove 106*c*. The coupling groove 106*c* may be provided in a number corresponding to the number of coupling protrusions 105.

The dispenser cover 106 may include a first kit groove 107*a* to which the ice kit 130 to be described later is to be mounted, and a second kit groove 107*b* to which the lever 124 is to be mounted. The first kit groove 107*a* may be provided at a position corresponding to the first discharge part opening 103*a* and the second kit groove 107*b* may be provided at a position corresponding to the second discharge part opening 103*b*.

The dispenser 120 may further include a reinforcing plate 125 supporting the door plate 101 at the rear surface of the door plate 101. The reinforcing plate 125 may be provided on the upper portion of the discharge part 123 and may contact a portion of the rear surface of the door plate 101 and may support a portion of the rear surface of the door plate 101. Accordingly, the reinforcing plate 125 may prevent the door plate 101 from being bent when the insulation material is formed between the rear cover 108 and the door plate 101 or when an impact is applied from the outside.

Referring to FIGS. 4 and 7, the door 100 may include the ice kit 130 configured to open or close the chute 122 to selectively provide ice according to the user's need. The ice kit 130 may include a baffle part 131 to open or close the chute 122, and a driving unit 132 for driving the baffle part 131.

The baffle part 131 may include a baffle case 131*a* fixed to the first kit groove 107*a* of the dispenser cover 106, and a baffle 131*b* that is rotatably coupled to the baffle case 131*a* and selectively opens or closes the chute 122.

The baffle case 131*a* may include baffle fixing portions 133*a*, 133*b* to be coupled to the dispenser cover 106. Referring to FIG. 5, although two baffle fixing portions 133*a*, 133*b* are shown as being provided, the number of the baffle fixing portions 133*a*, 133*b* may be changed as needed. The baffle fixing portions 133*a*, 133*b* are disposed to correspond to a first hole 109*a* and a second hole 109*b* of the dispenser cover 106 respectively and then the coupling member such as a screw is inserted into the baffle fixing portions 133*a*, 133*b* and the first hole 109*a* and the second hole 109*b*. Accordingly, the baffle part 131 may be fixed to the dispenser cover 106.

The baffle 131*b* may be rotatably coupled to the baffle case 131*a*. Specifically, the baffle 131*b* may be coupled to the baffle case 131*a* to selectively open and close the chute 122. The baffle 131*b* may be connected to the driving unit 132 to receive a driving force from the driving unit 132.

The driving unit 132 may be fixed to the first kit groove 107*a* of the dispenser cover 106. The driving unit 132 may include a driving source (not shown) to generate a driving force to rotate the baffle 131*b*. The driving unit 132 may be connected to the baffle 131*b* to transmit the driving force to the baffle 131*b*.

The driving unit 132 may include driving unit fixing portions 134*a*, 134*b* to be coupled to the dispenser cover 106. Referring to FIG. 5, although two driving unit fixing portions 134*a*, 134*b* are shown, the number of the driving unit fixing portions 134*a*, 134*b* may be changed as needed. The driving unit fixing portions 134*a*, 134*b* are disposed to correspond to the second hole 109*b* and a third hole 109*c* of the dispenser cover 106 respectively and then the coupling member such as a screw is inserted into the driving unit fixing portions 134*a*, 134*b* and the second hole 109*b* and the third hole 109*c*. Accordingly, the driving unit 132 may be fixed to the dispenser cover 106.

The second hole 109*b* of the dispenser cover 106 may be used as a hole for the baffle fixing portion 133*b* of the baffle case 131*a* and the driving unit fixing portion 134*a* of the driving unit 132 to be coupled to the dispenser cover 106. Considering the assembly sequence, the driving unit fixing portion 134*a* of the driving unit 132 is first positioned at a position corresponding to the second hole 109*b* of the dispenser cover 106, and then the baffle fixing portion 133*b* of the baffle case 131*a* of the baffle part 131 is positioned to correspond to the driving unit fixing portion 134*a* of the driving unit 132. Then a coupling member such as a screw is inserted into the second hole 109*b* of the dispenser cover 106, the driving unit fixing portion 134*a* of the driving unit 132, and the baffle fixing portion 133*b* of the baffle part 131. Accordingly, the dispenser cover 106, the baffle part 131, and the driving unit 132 may be mutually fixed.

As described above, the door 100 of the refrigerator 1 according to the embodiment of the present disclosure may be provided with the baffle part 131 and the driving unit 132 and then the driving unit 132 and the baffle part 131 may be sequentially assembled to the dispenser cover 106. Therefore, it is possible to solve the problem in that the space where the ice kit 130 may be assembled becomes narrow as the door plate 101 covers the front surface of the dispenser 120.

FIGS. 8 to 11 are views illustrating a process of assembling the door 100 shown in FIG. 3.

Hereinafter, a method for assembling the door described above with reference to FIGS. 8 to 11 will be described.

Figure 8:
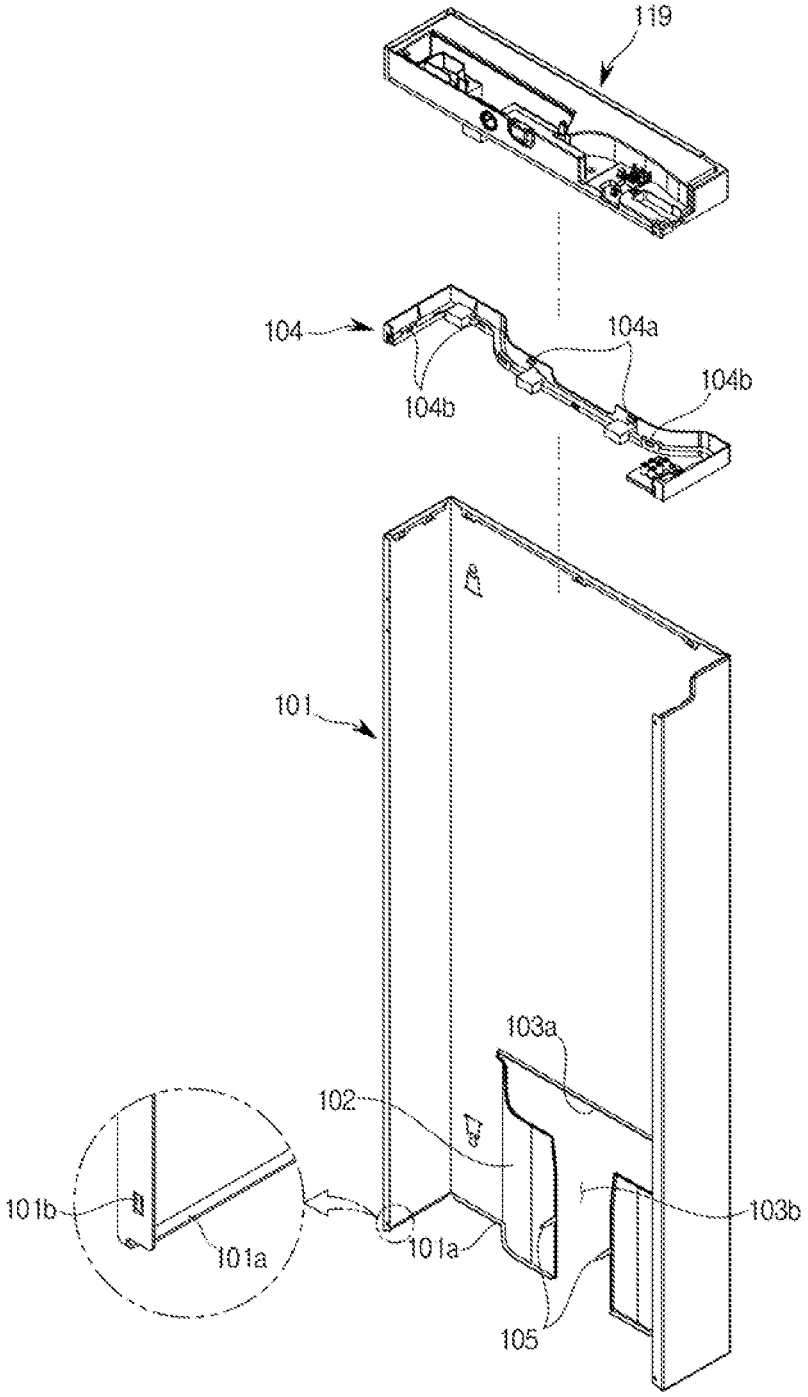
FIGS. 8 to 11 are views illustrating a process of assembling the door shown in FIG. 3.

Referring to FIG. 8, first, the support member 104 may be inserted into the inside of the door plate 101 through the upper end of the door plate 101. Specifically, the support member 104 may move from the upper end to the lower end of the door plate 101 and may be seated in the inner bending portion 101*a* of the door plate 101. The support member 104 seated on the bending portion 101*a* may be firmly fixed to the door plate 101 by a coupling member such as a screw of the like. The door plate 101 may include a coupling hole 101*b*.

The upper door cap 119 may be coupled to the upper end portion of the door plate 101 to cover the upper end of the door plate 101.

Figure 9:
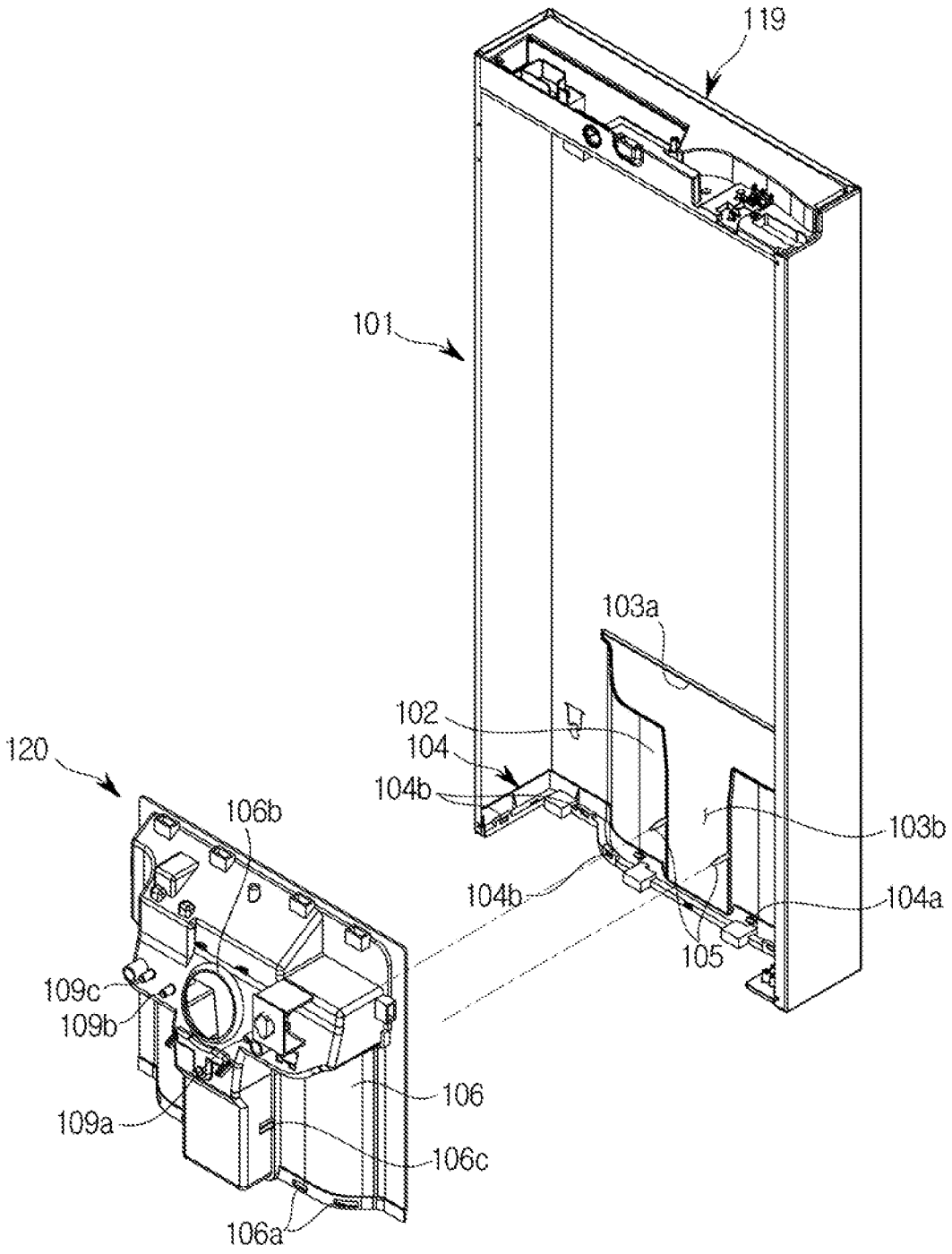

Referring to FIG. 9, the dispenser cover 106 on which the dispenser 120 is mounted may move in the direction toward the front side from the rear side of the door plate 101 and may be coupled to the rear side of the door plate 101.

As described above, the third coupling portion 106*a* of the dispenser cover 106 may be coupled to the first coupling portion 104*a* of the support member 104 and the coupling protrusion 105 of the door plate 101 may be inserted into the coupling groove 106*c* of the dispenser cover 106. The discharge cover 126 covering the discharge part 123 of the dispenser 120 and the lever 124 may be exposed to the outside of the door plate 101 through the discharge part openings 103*a*, 103*b* of the door plate 101.

Figure 10:
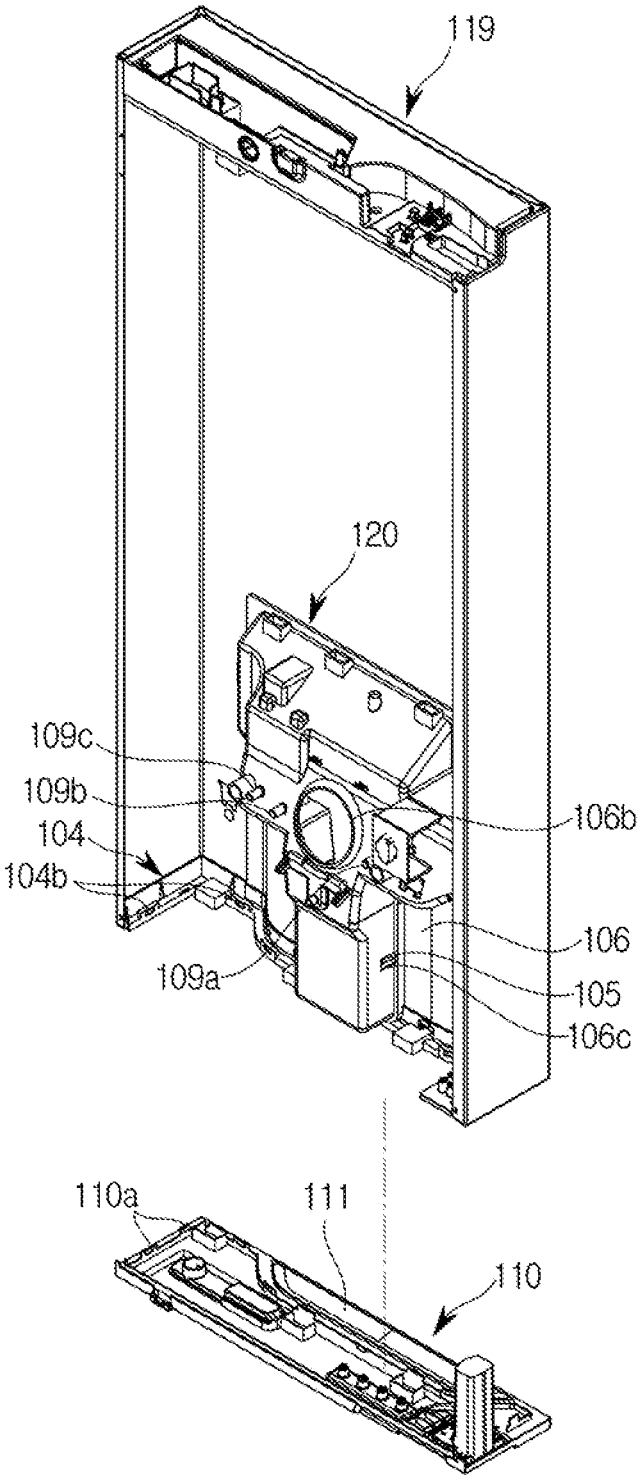

Referring to FIG. 10, the lower door cap 110 may move upward from the lower side of the door plate 101 and may be coupled to the lower end portion of the door plate 101.

As described above, the fourth coupling portion 110*a* of the lower door cap 110 may be coupled to the second coupling portion 104*b* of the support member 104. The water collecting part 111 of the lower door cap 110 is located at a position where it may collect the water flowing from the discharge part 123 of the dispenser 120. As the lower door cap 110 is coupled to the door plate 101, the dispensing space 121 may be formed.

Figure 11:
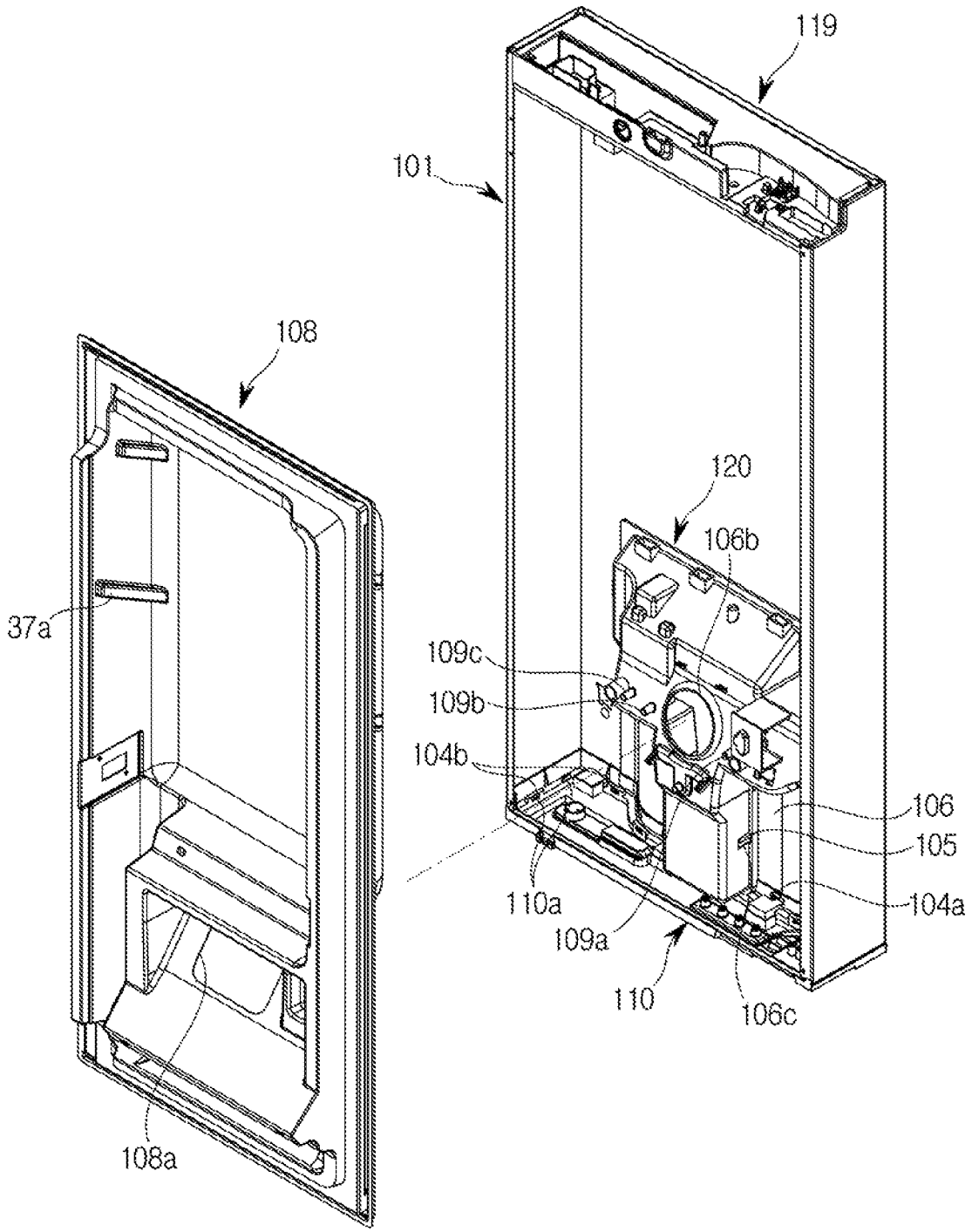

Referring to FIG. 11, the rear cover 108 moves forward from the rear of the door plate 101 and may couple to the rear surface of the door plate 101. The rear cover 108 may be coupled to the door plate 101 in a screw manner, however is not limited thereto, and may be coupled in various ways such as a snap fit type or a hook type.

After the rear cover 108 is coupled to the door plate 101, the space between the door plate 101 and the rear cover 108 may be filled with foamed urethane and foamed to form the insulation material. The rear cover 108 and the door plate 101 may be more firmly coupled by the insulation material.

Figure 20:
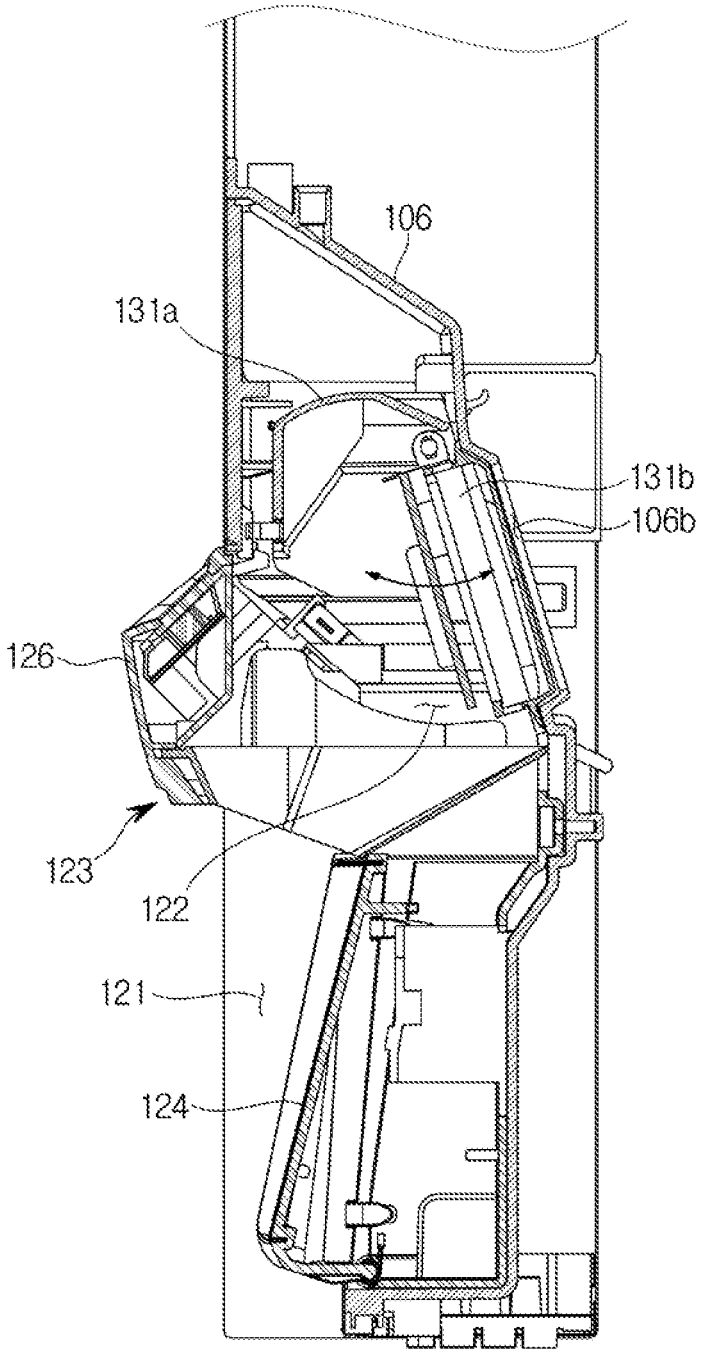
FIGS. 20 and 21 are cross-sectional views showing a state in which a baffle part of the ice kit shown in FIG. 4 opens or closes a chute.
Figure 21:
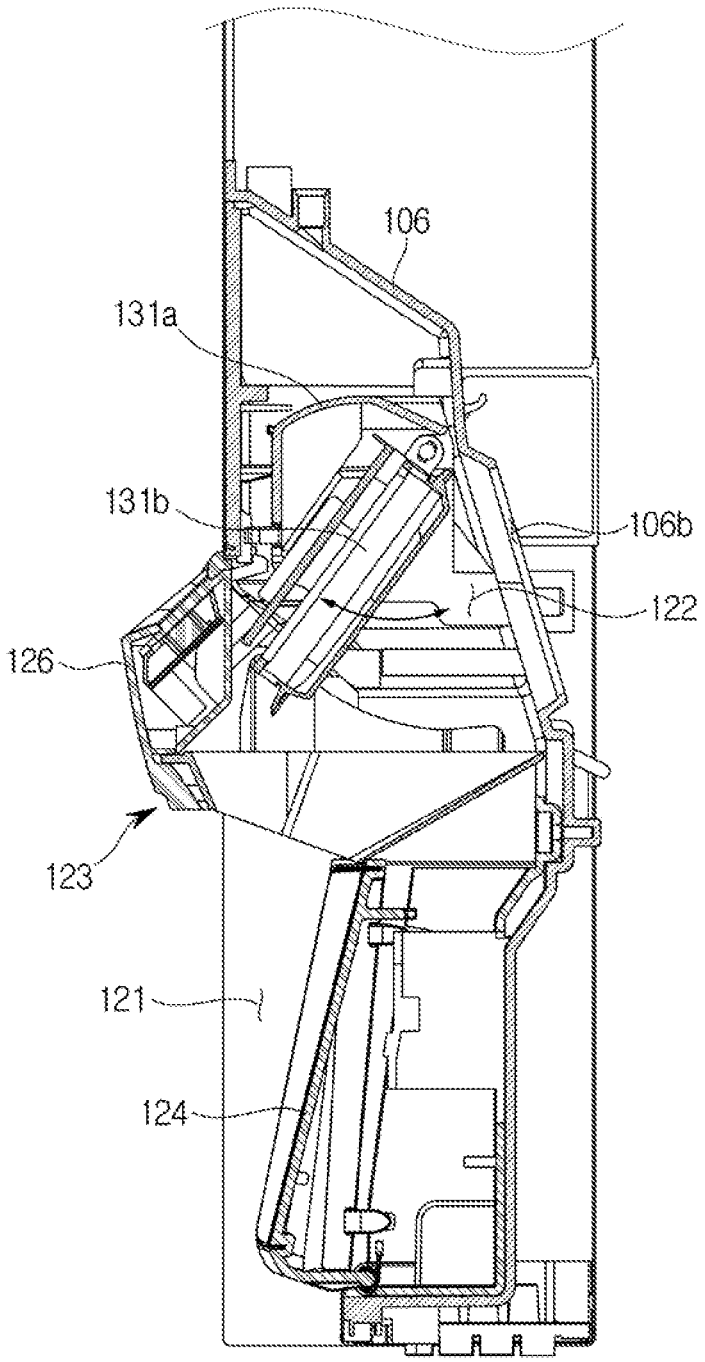

FIGS. 12 to 19 are views illustrating a process of assembling the ice kit 130 shown in FIG. 4. FIGS. 20 and 21 are cross-sectional views showing a state in which the baffle part 131 of the ice kit 130 shown in FIG. 4 opens or closes the chute 122.

Referring to FIGS. 12 to 19, the process of mounting the ice kit 130 on the door 100 will be described in sequence.

Figure 12:
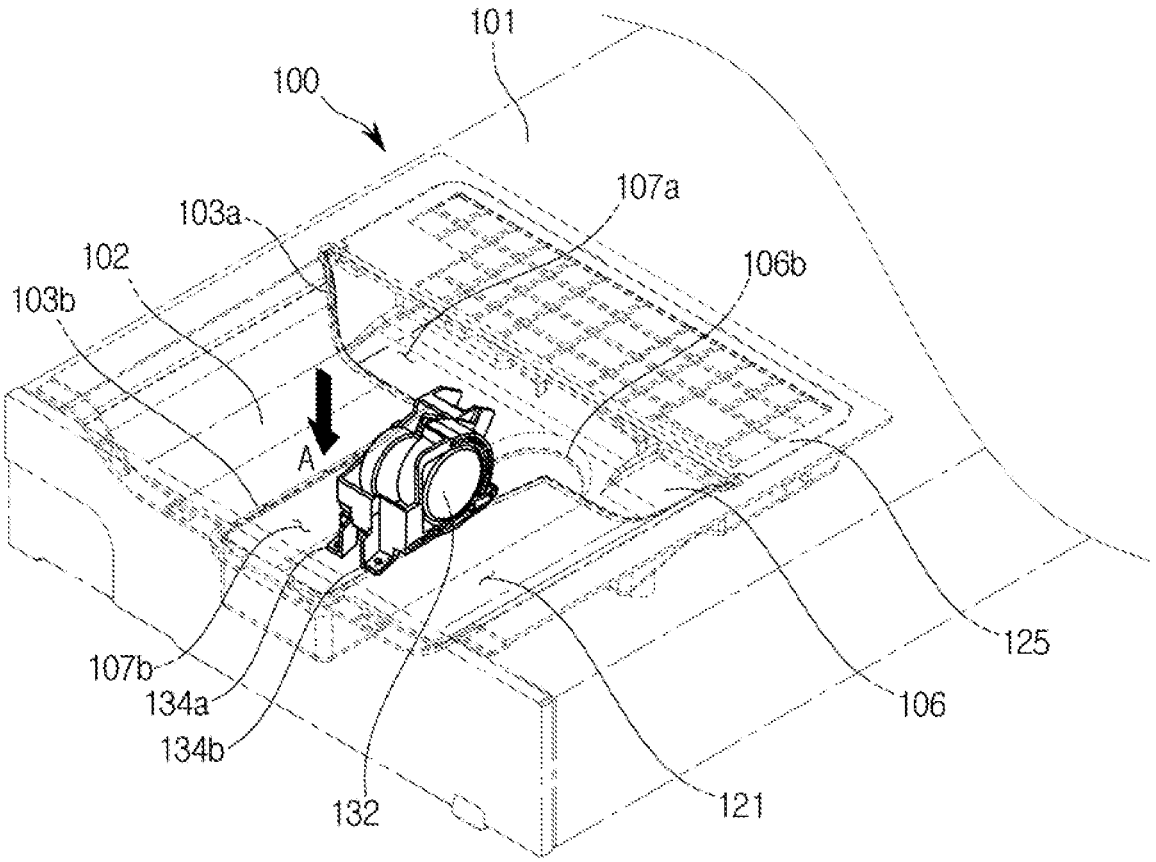
FIGS. 12 to 19 are views illustrating a process of assembling the ice kit shown in FIG. 4.

Referring to FIG. 12, the driving unit 132 may move along a direction A and may be moved into the inside of the second kit groove 107*b* through the second discharge part opening 103*b* of the door 100 in which the insulation material is formed.

Figure 13:
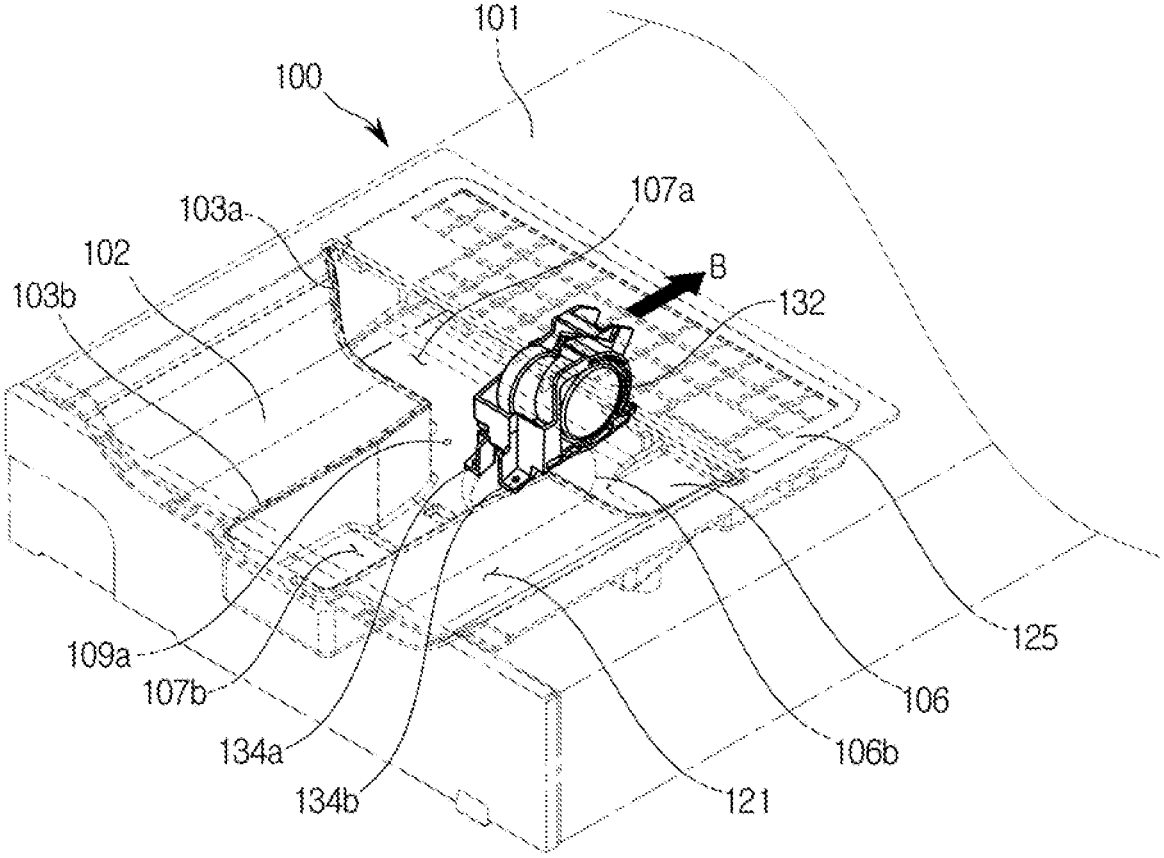

Referring to FIG. 13, the driving unit 132 may move along a direction B and may be moved into the inside of the first kit groove 107*a*.

Figure 14:
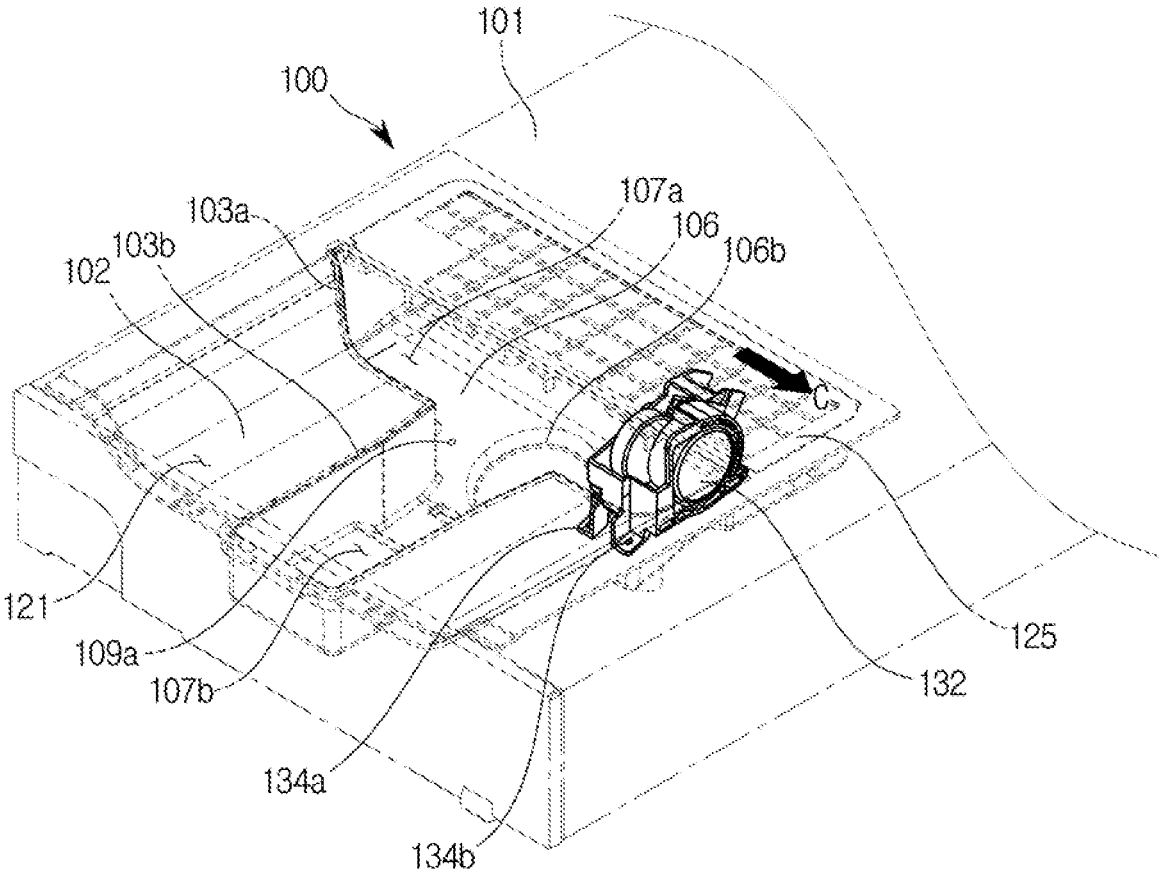

Referring to FIG. 14, the driving unit 132 may move along a direction C and may be moved to one side of the first kit groove 107*a*. In this state, the driving unit fixing portions 134*a*, 134*b* of the driving unit 132 may be positioned to correspond to the second hole 109*b* and the third hole 109*c* of the dispenser cover 106, respectively. In this state, a coupling member (not shown) may be coupled to the driving unit fixing portion 134*b* and the third hole 109*c*, therefore, one side of the driving unit 132 may be fixed to the dispenser cover 106.

Figure 15:
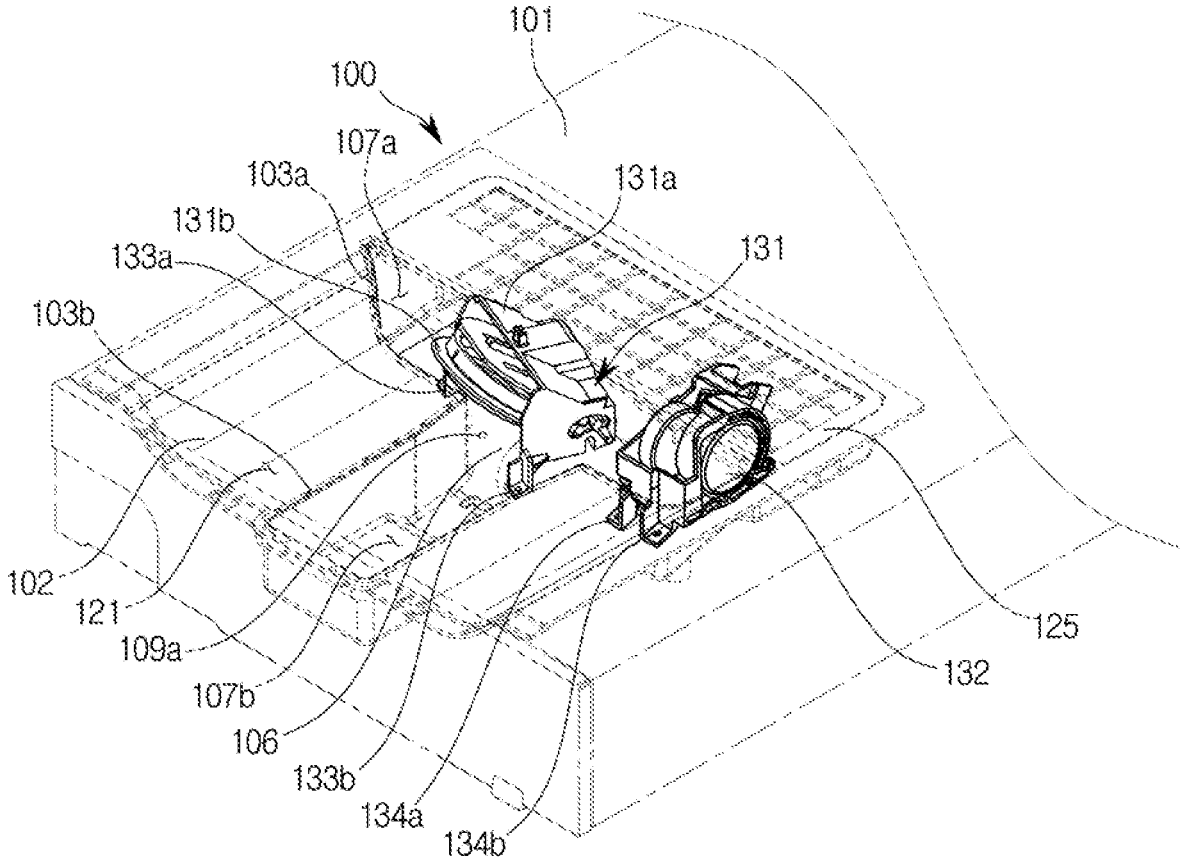

Referring to FIG. 15, the baffle part 131 may be moved in a tilted state such that the baffle fixing part 133*a* provided at one side of the baffle part 131 may be inserted into the first kit groove 107*a*. At this time, the baffle fixing portion 133*b* provided on the other side of the baffle part 131 may not be inserted into the first kit groove 107*a* or the second kit groove 107*b*.

Figure 16:
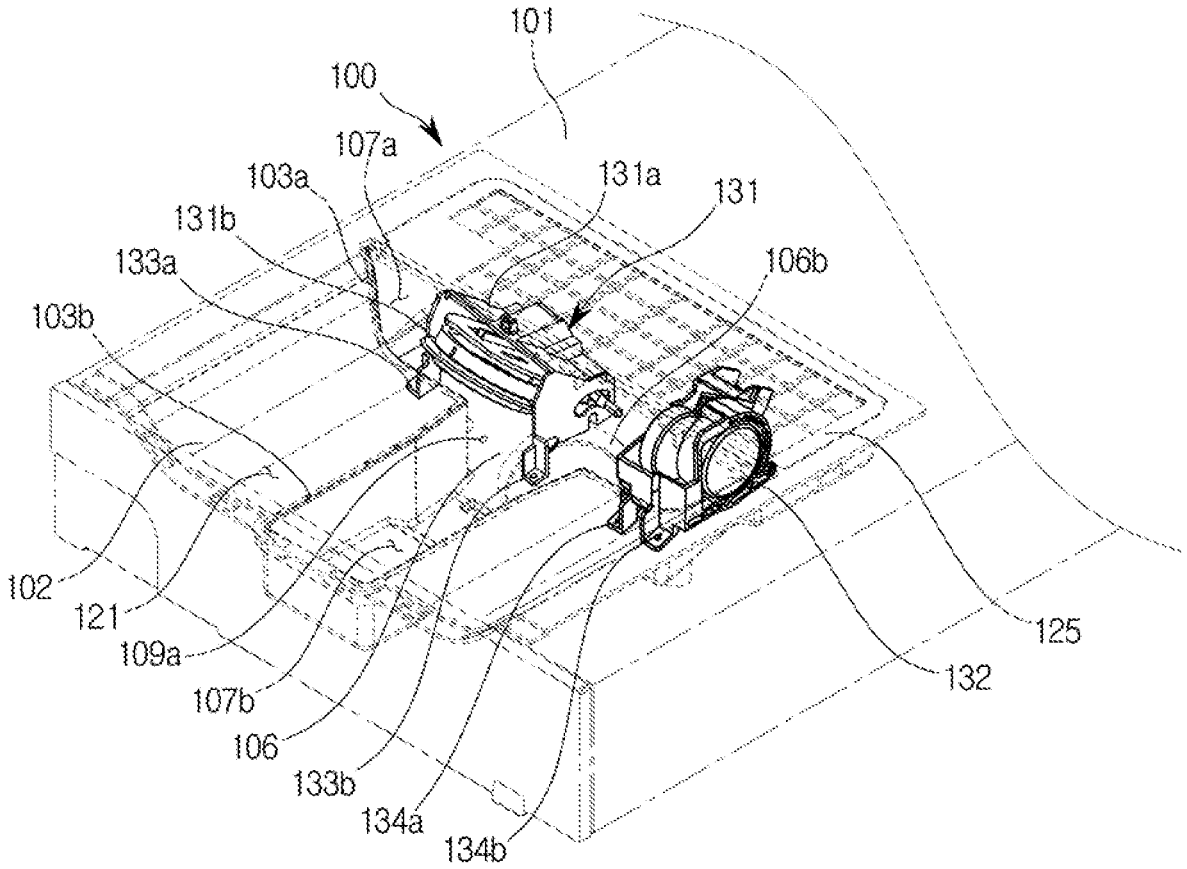

Referring to FIG. 16, as one side of the baffle part 131 is moved toward one side of the first kit groove 107*a*, the baffle case 131*a* may be moved to the inside of the first kit groove 107*a*. One side of the baffle part 131 is moved toward one side of the first kit groove 107*a* such that the baffle fixing part 133*b* located at the other side of the baffle part 131 may move into the inside of the first kit groove 107*a*.

Figure 17:
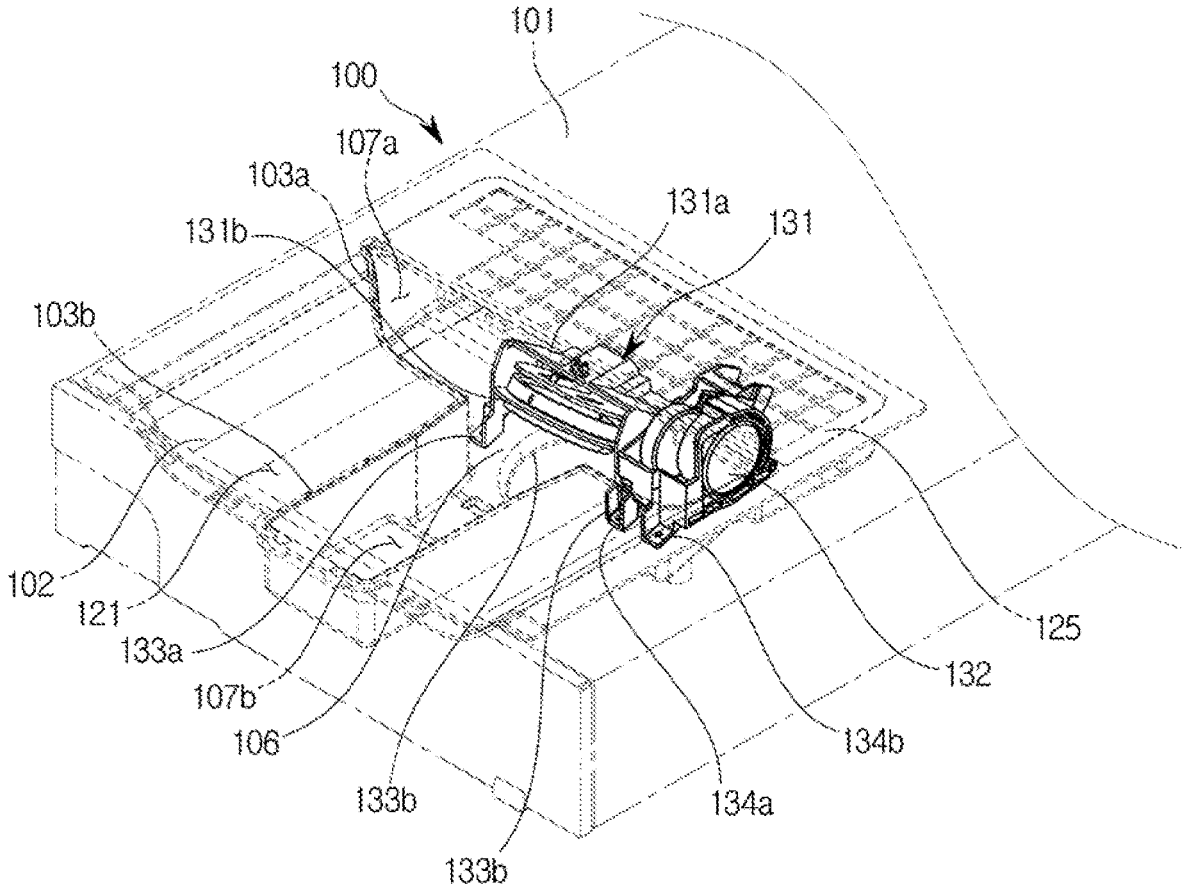

Referring to FIG. 17, the baffle part 131 may be moved so that the baffle fixing part 133*a* provided at one side of the baffle part 131 is located at a position corresponding to the first hole 109*a* of the dispenser cover 106. The baffle fixing portion 133*b* provided on the other side of the baffle part 131 may move to a position corresponding to the second hole 109*b* of the dispenser cover 106. The baffle fixing portion 133*b* provided at the other side of the baffle part 131 may be arranged to overlap the driving unit fixing portion 134*a* at a position corresponding to the second hole 109*b*.

Figure 18:
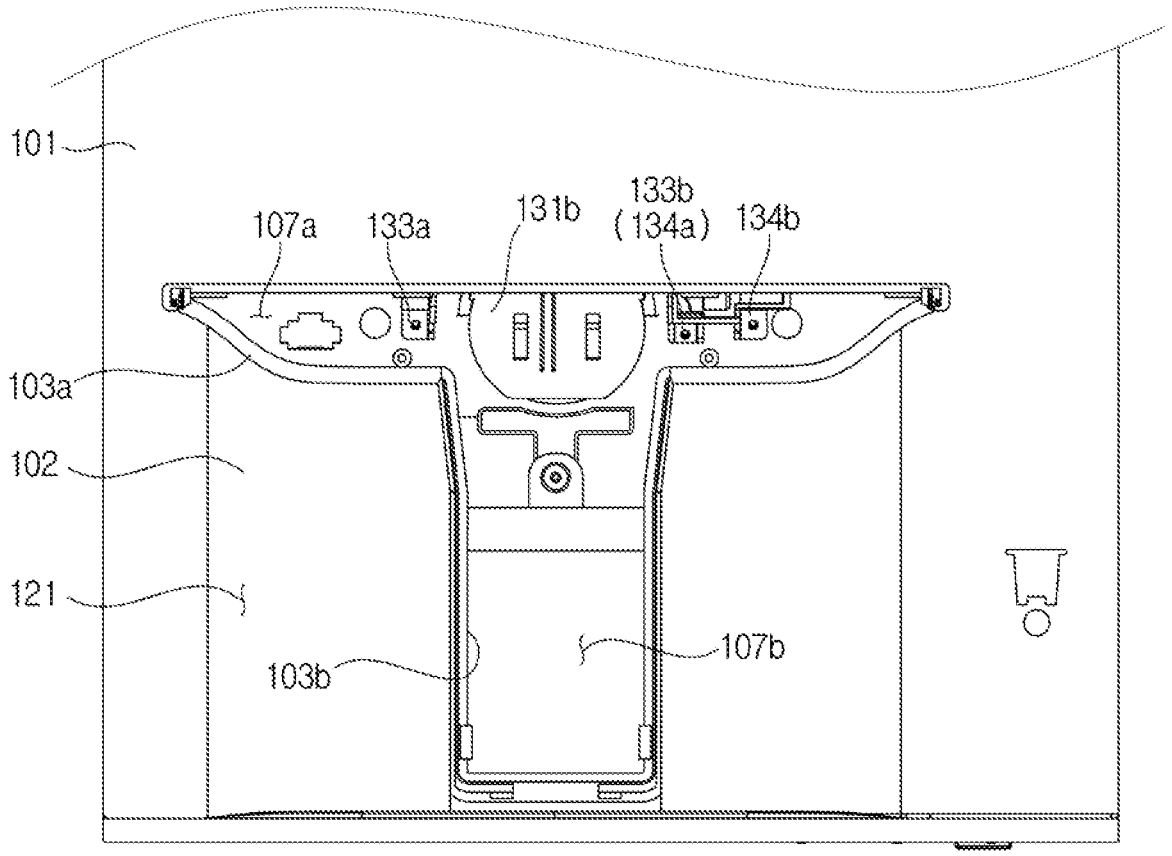

In other words, referring to FIG. 18, the baffle fixing portion 133*a* provided on one side of the baffle part 131 may be coupled with the first hole 109*a* by a coupling member at a position corresponding to the first hole 109*a* of the dispenser cover 106 and the baffle fixing portion 133*b* provided on the other side of the baffle part 131 may be coupled with the second hole 109*b* and the driving unit fixing portion 134*a* of the driving unit 132 by a coupling member at a position corresponding to the second hole 109*b* of the dispenser cover 106. The driving unit fixing portion 134*a* provided at one side of the driving unit 132 may be coupled with the second hole 109*b* and the baffle fixing portion 133*b* provided on the other side of the baffle part 131 and the driving unit fixing portion 134*b* provided on the other side of the driving unit 132 may be coupled with the third hole 109*c* by a coupling member at a position corresponding to the third hole 109*c* of the dispenser cover 106.

Although the method of mounting the ice kit 130 on the dispenser cover 106 has been described above, the manner in which the ice kit 130 is mounted on the dispenser cover 106 is not limited thereto, and any method may be applied as long as the ice kit 130 is separated into the baffle part 131 and a driving unit 132.

Figure 19:
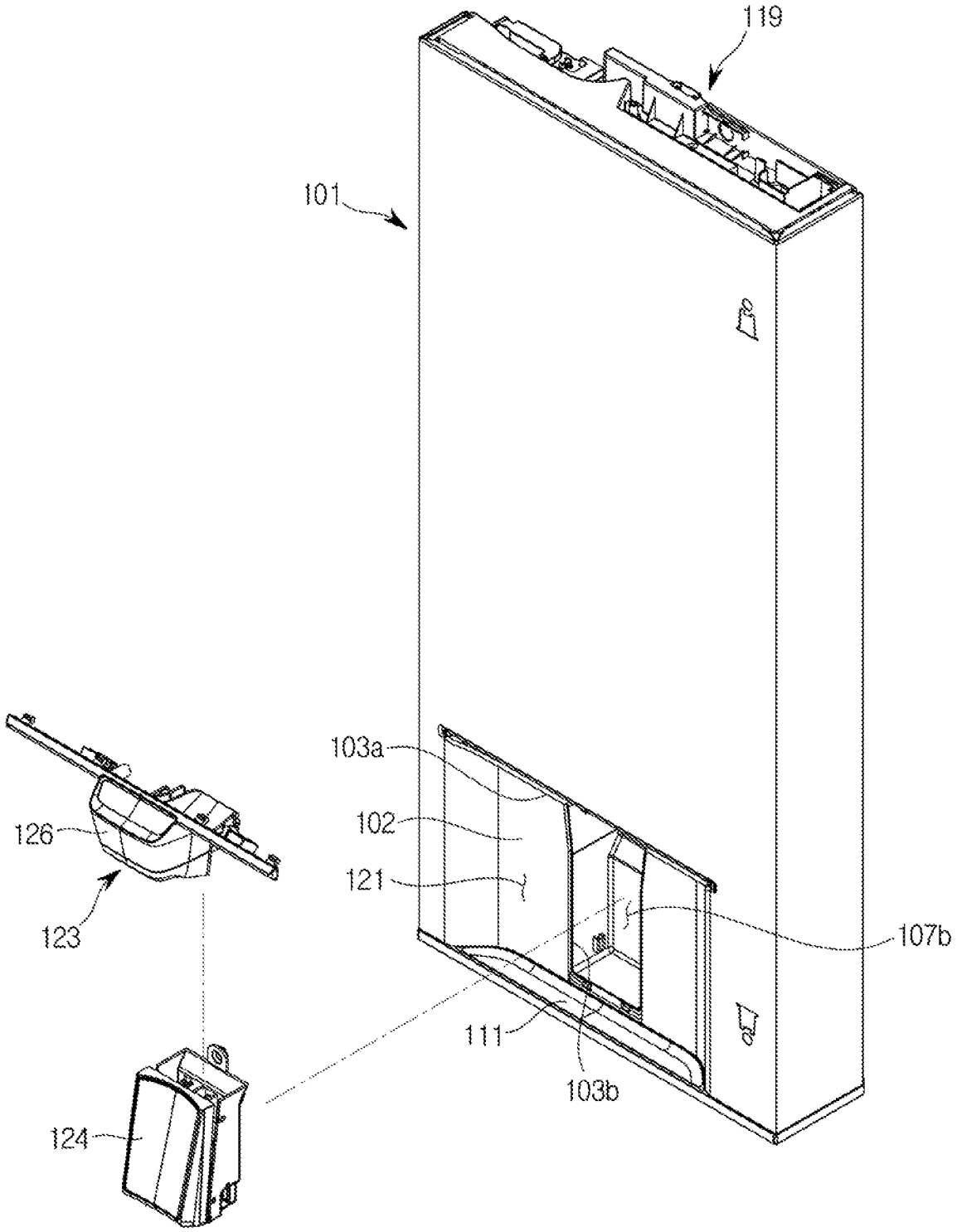

Referring to FIG. 19, the door 100 on which the ice kit 130 is mounted may be provided with the discharge part 123, the discharge part cover 126 covering the discharge part 123, and the lever 124.

Referring to FIGS. 20 and 21, the operation of opening or closing the chute 122 by the baffle 131*b* will be described.

Referring to FIG. 20, when the user is not provided with ice, the baffle 131*b* may be rotated in a direction to close the discharge port 106*b* of the dispenser cover 106 so that ice is not supplied to the outside of the door 100 through the discharge part 123.

Referring to FIG. 21, when the user is provided with ice, the baffle 131*b* may be rotated in a direction to open the discharge port 106*b* of the dispenser cover 106 so that the ice may be supplied to the outside of the door 100 through the discharge part 123. The baffle 131*b* receives a rotational force from the driving unit 132 and the driving unit 132 is driven by a control unit (not shown) connected to the lever 124 when the user inputs a command through the lever 124.

As described above, since the water collecting part 111 capable of collecting water and/or ice that may flow in the discharge part 123 of the dispenser 120 is provided in the lower door cap 110 of the door 100 and the front cover portion 102 of the door plate 101 of the door 100 covers the front surface of the dispenser 120, the refrigerator 1 according to an embodiment of the present disclosure may give the impression that the dispenser 120 and the door 100 are integrated. Since the water collecting part 111 is formed simply on the door 100 without forming a separate water collecting part on the dispenser 120, the manufacturing is easy and the structure is simple, and the material cost may be reduced.

Figure 22:
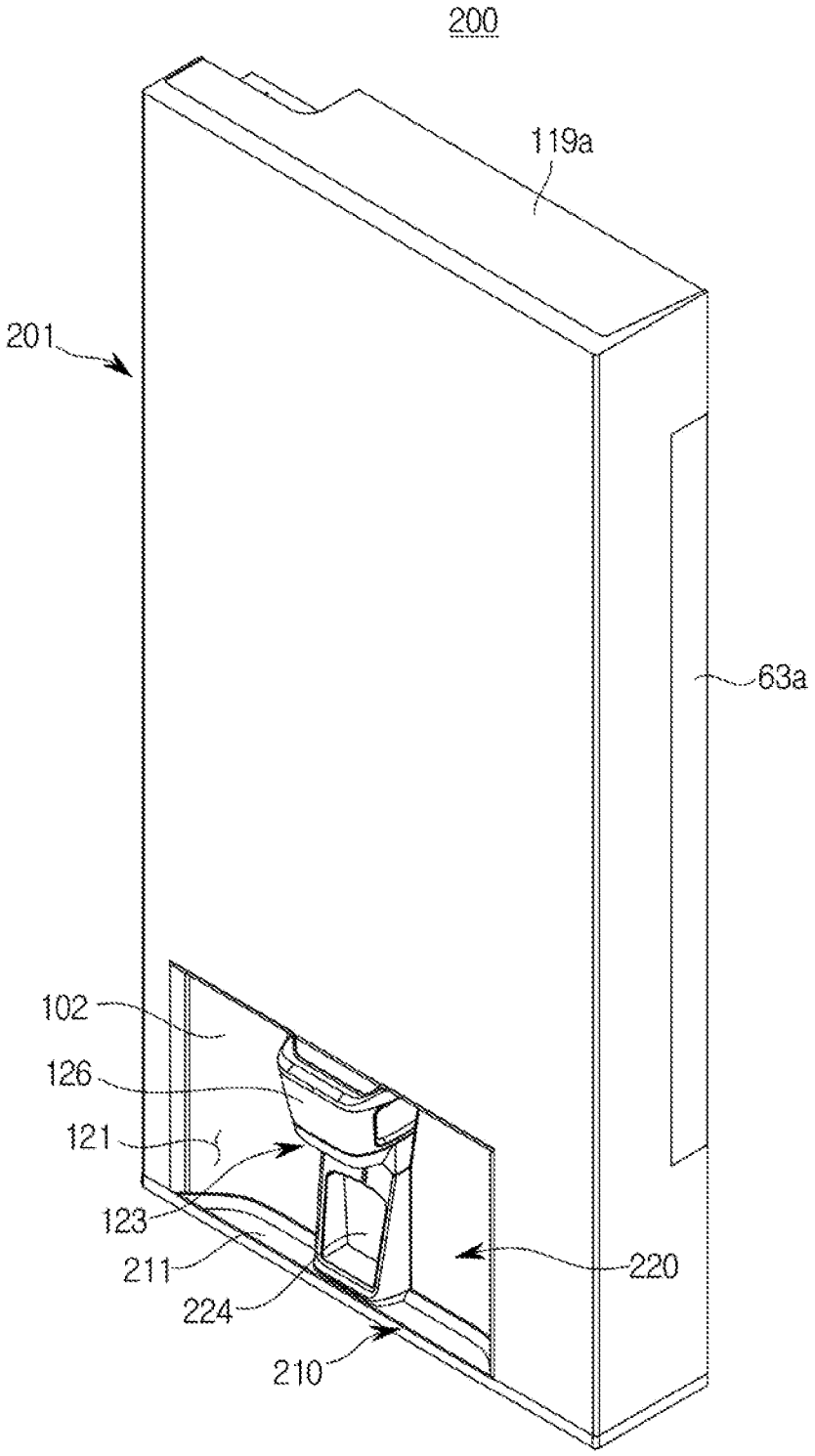
FIG. 22 is a view illustrating a door according to another embodiment of the present disclosure.
Figure 23:
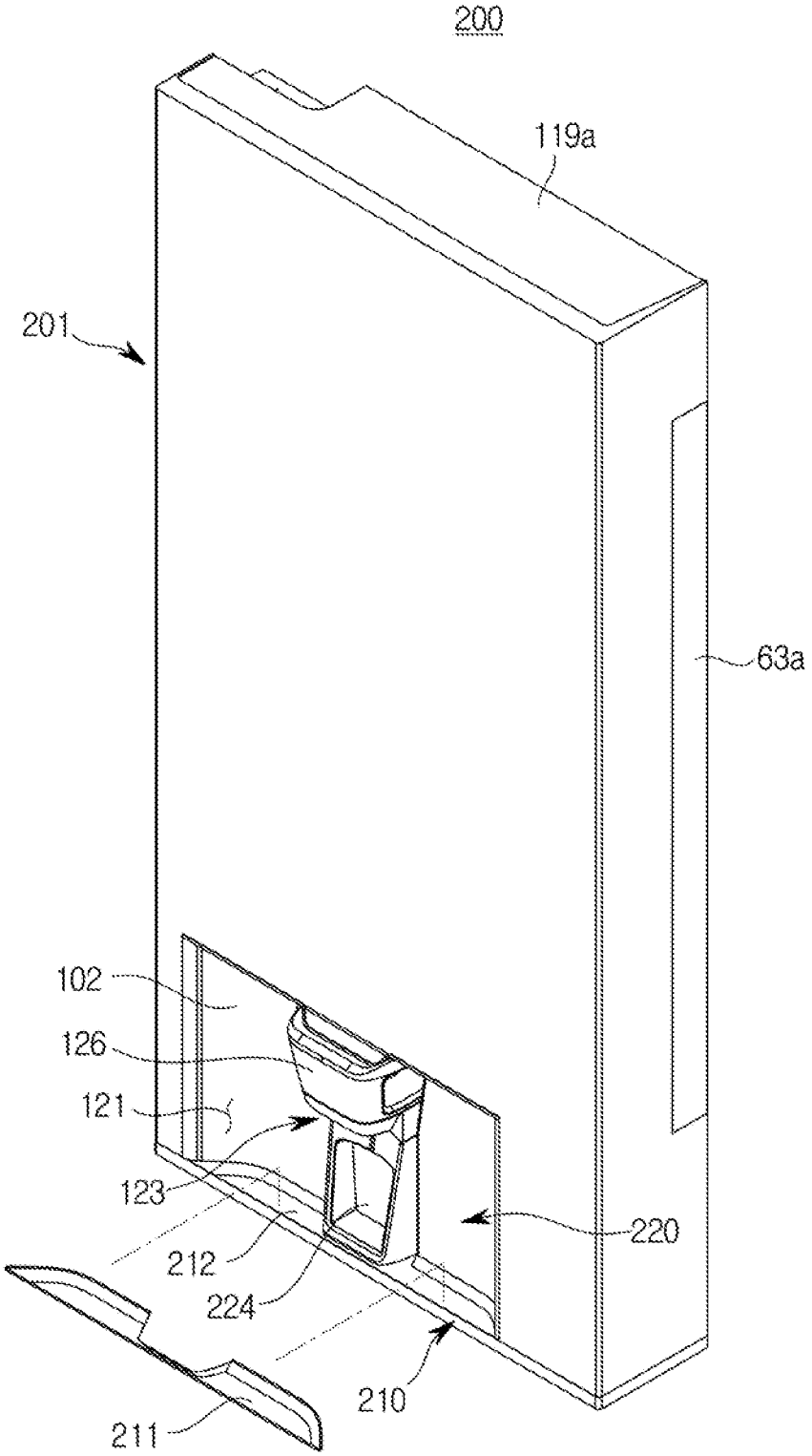
FIG. 23 is a view illustrating a state where a water collecting part is separated from the door shown in FIG. 22.

FIG. 22 is a view illustrating a door 200 according to another embodiment of the present disclosure. FIG. 23 is a view illustrating a state where a water collecting part 211 is separated from the door 200 shown in FIG. 22.

The door 200 of the refrigerator according to another embodiment of the present disclosure will be described with reference to FIGS. 22 and 23. The same reference number are assigned to the same components as those of the above-described embodiments, and the description thereof may be omitted. FIGS. 22 and 23 show that the additional cover 119*a* is mounted on the upper door cap (not shown) of the door 200, unlike in the embodiment shown in FIG. 3.

Referring to FIGS. 22 and 23, the door 200 of the refrigerator according to another embodiment of the present disclosure may be provided with the water collecting part 211 provided on a lower door cap 210 in a detachable manner in the lower door cap 210. The water collecting part 211 may be removably seated in a seating portion 212 of the lower door cap 210.

Specifically, the water collecting part 211 may extend a predetermined length along the left and right width direction of the door 200 and may be recessed in the vertical direction to form a collecting space 211*a* therein. In addition, as shown in FIG. 22, the water collecting part 211 may be recesses forward from the rear in a substantially central portion so as not to interfere with a switch portion 224.

The lower door cap 210 may include the seating portion 212 provided in a shape corresponding to the shape of the water collecting part 211 so that the water collecting part 211 may be seated.

According to this configuration, the user may separate the water collecting part 211 from the lower door cap 210 to remove the water and/or ice collected in the water collecting part 211 and may mount the water collecting part 211 with water and/or ice removed to the lower door cap 210 again. The water collecting part 211 may move downward from the upper side of the lower door cap 210 and may be seated in the seating portion 212.

The door 200 of the refrigerator according to another embodiment of the present disclosure may include a handle

63*a* formed on the side surface of a door plate 201, unlike the handle 63 of the door 100 shown in FIG. 3.

A dispenser 220 of the door 200 of the refrigerator according to another embodiment of the present disclosure may include the switch portion 224 unlike the lever 124 of the door 100 shown in FIG. 3. The lever 124 shown in FIG. 3 actuates the dispenser 120 as it is pressurized, however, the switch portion 224 may automatically provide water and/or ice when the container is placed in the switch portion 224 by a sensor (not shown). An infrared sensor may be used as the sensor, however, the present disclosure is not limited thereto.

According to the present disclosure, the refrigerator may reduce the number of components by providing the water collecting part of the dispenser on the door, thereby reducing the material cost.

According to the present disclosure, the refrigerator may reduce the number of components by covering the front surface of the dispenser by the door, thereby reducing the material cost.

According to the present disclosure, the refrigerator may improve the design of the door with the dispenser by disposing the dispenser at the bottom of the door and providing the water collecting part at the door cap.

According to the present disclosure, in the refrigerator, the ice kit is divided into the baffle part and the driving unit, and then assembled to the door sequentially, so that the ice kit may be easily assembled even in a small assembly space.

According to the present disclosure, the ice kit is mounted on the dispenser cover, so that the ice kit may be assembled into the dispenser cover even after the insulation material is formed inside the door.

According to the present disclosure, since the ice kit is divided into the baffle part and the driving unit, the ice kit may be mounted on the dispenser cover after forming the insulation material inside the door of the refrigerator, so that the ice kit may be easily replaced.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator, comprising:

a main body having a storage compartment;

a door to open or close the storage compartment; and a dispenser provided at a lower end portion of the door to supply water to an outside of the main body, and including a dispensing space, wherein the door includes:

a door plate forming a front surface of the door and side surfaces of the door, and including:

a front cover portion recessed from the outer surface of the door plate to cover a front surface of the dispenser, an opening extending through the front cover portion from a bottom end of the door plate to expose at least a portion of the dispenser through the opening in the front cover portion; and a support member provided at a rear portion of the bottom end portion of the door plate;

a handle mounted on the door plate; and a door cap coupled to the bottom end of the door plate to form the dispensing space, coupled to the support member to support the door plate, and including a water collecting part recessed from an upper surface of the door cap to collect residual water of the dispenser, and wherein the dispenser includes a dispenser cover coupled to a rear of the front cover portion to cover a rear of the dispenser.

2. The refrigerator of claim 1, wherein:

the dispenser has a discharge part; and the front cover portion includes the opening.

3. The refrigerator of claim 2, wherein:

the discharge part includes a lever to operate the dispenser to discharge water; and at least a portion of the lever is exposed to the outside of the door through the opening.

4. The refrigerator of claim 1, wherein the dispenser cover is further configured to be coupled to the support member in a snap-fit manner.

5. The refrigerator of claim 1, wherein the door cap is configured to be coupled to the support member in a snap-fit manner.

6. The refrigerator of claim 4, wherein the support member includes at least one first coupling portion coupled to the dispenser cover, and at least one second coupling portion coupled to the door cap.

7. The refrigerator of claim 1, wherein the water collecting part is attachable to or detachable from the door cap.

8. The refrigerator of claim 7, wherein the door cap is provided to correspond to a shape of the water collecting part and further includes a seating portion on which the water collecting part is seated.

9. The refrigerator of claim 1, wherein the dispenser includes a reinforcing plate in contact with a portion of a rear surface of the door plate and provided to support the portion of the rear surface of the door plate.

10. The refrigerator of claim 1, wherein at least a portion of the door cap is provided below the bottom end of the door plate.

* * * * *